United States Patent [19]

Eisermann

[11] Patent Number: 4,932,228

[45] Date of Patent: Jun. 12, 1990

[54] LOCKING DEVICE HAVING A LARGE NUMBER OF LOCKING COMBINATIONS

[75] Inventor: Armin Eisermann, Velbert, Fed. Rep. of Germany

[73] Assignee: Schulte-Schlagbaum Aktiengesellschaft, Velbert, Fed. Rep. of Germany

[21] Appl. No.: 148,731

[22] Filed: Jan. 26, 1988

[30] Foreign Application Priority Data

Jan. 30, 1987 [DE] Fed. Rep. of Germany ..... 3702730
Oct. 12, 1987 [DE] Fed. Rep. of Germany ..... 3734399

[51] Int. Cl.[5] ..... E05B 47/00

[52] U.S. Cl. ..... 70/276; 70/413; 70/DIG. 41; 194/248

[58] Field of Search ..... 70/276, 413, DIG. 41; 194/4 R, 4 B, 4 C, 4 D, 51, 59, 65, 248

[56] References Cited

U.S. PATENT DOCUMENTS

| | | | |
|---|---|---|---|
| 2,842,876 | 7/1958 | Chicoine et al. | 70/413 |
| 2,914,746 | 11/1959 | James | 70/413 X |
| 3,154,761 | 10/1964 | O'Gorman | 70/276 X |
| 3,403,380 | 9/1968 | Welch | 70/276 |
| 3,444,711 | 5/1969 | Sedley | 70/276 |
| 3,581,030 | 5/1971 | Sedley | 70/276 |
| 3,595,042 | 7/1971 | Sedley | 70/276 |
| 3,680,336 | 8/1972 | Schendel | 70/276 |
| 4,133,194 | 1/1979 | Sedley et al. | 70/413 X |
| 4,397,166 | 8/1983 | Paar | 70/276 |
| 4,519,228 | 5/1985 | Sornes | 70/276 |
| 4,534,194 | 8/1985 | Aydin | 70/276 X |
| 4,572,348 | 2/1986 | Eisermann et al. | 70/413 X |
| 4,656,850 | 4/1987 | Tabata | 70/276 |
| 4,727,975 | 3/1988 | Eisermann | 70/276 X |
| 4,788,623 | 11/1988 | Haug | 70/413 X |

*Primary Examiner*—Gary L. Smith
*Assistant Examiner*—Suzanne L. Dino
*Attorney, Agent, or Firm*—Martin A. Farber

[57] ABSTRACT

A locking device includes a lock and key and has tumblers which can be brought by a key into a release position, and provides, in particular, for a large number of closing combinations, that at least one of the tumblers can be brought, in addition or alternatively to its direct control by the base code of the corresponding key, by means of a magnet coil into a release position. The coil is energizable by a reading device which detects at least one supplementary code of the key.

33 Claims, 19 Drawing Sheets

LOCKING DEVICE HAVING A LARGE NUMBER OF LOCKING COMBINATIONS

FIELD AND BACKGROUND OF THE INVENTION

The present invention relates to a locking device which consists of a lock and a key and which has tumblers that can be brought into a release position by the key.

Such locking devices are known. They can be formed, for instance, of locking cylinders which can be locked by flat keys or else also of locking devices which are operated with magnetic keys.

All of these locking devices share the common feature that while the number of locking combinations is frequently considerable, this number however, could be further increased in order to increase security. Particularly with respect to locking systems having master and specific keys there is a need to make available in a locking system a large number of keys which have different access authorizations. Such locking systems frequently have the disadvantage that the main master key which can be used for all locks of the locking system has only a relatively simple coding. In the case of locking devices which are used by continuously changing users (for instance, in hotels), it is necessary to ensure that the previous user cannot easily obtain a copy of the key, which would raise the possibility of his unauthorized access into the room inhabited by the subsequent user.

In many known locking devices an increase in the number of locking combinations also means an increase in the structural size of the key, which has a detrimental effect on convenience.

It is therefore an object of the present invention to create a locking device of the aforementioned type with which the number of locking combinations is increased without enlarging the structural shape of the key. In particular, there also exists an emergency key which, in emergency situations, permits opening the lock, and it is therefore necessary to ensure in the case of systems with continuously changing users that unauthorized actuation of the lock cannot be effected. Furthermore, misuse of the emergency key should be made difficult and the possible uses for the locking should be increased.

SUMMARY OF THE INVENTION

This object is achieved in accordance with the invention by providing that at least one of the tumblers, in addition or as an alternative to its direct control by the basic code of the corresponding key, can be brought into its position of release by a magnetic coil which can be energized by a reading device which detects at least one supplementary code of the key. In principle, the locking device of the invention can thus be actuated by the key which actuates a given number of tumblers in the customary manner (for instance, mechanically or by permanent magnet), particularly in the case of coded magnetic cards. At least one tumbler, however, can be brought, in accordance with the invention, by given keys into a release position exclusively by means of the magnetic coil, the energizing of the magnetic coil being effected by the reading device which detects the supplementary code of the key upon insertion into the locking device. If this supplementary code corresponds to the lock coding then the corresponding tumbler is released. In accordance with the invention, thus the existing key coding, i.e. the basic code (for instance locking notches, specially arranged permanent magnets) is provided with a supplementary coding (supplementary code), whereby additional security is created. Such a supplementary code, which can be developed as bar code and/or as a pattern of holes passing through the key and/or as a magnetic code (particularly a magnetic strip code) which can be detected by an induction reading head, does not increase the structural size of the key. The key can preferably be constructed as a card. The supplementary code, however, together with the normal key code results in a substantial increase in the number of coding combinations. Furthermore, the bar code can be changed in simple manner if it is applied as an adhesive label on the key. The punch-hole code can be changed by means of additional holes. A change in the magnetic code is effected by additional permanent magnets or, in the case of magnetic strip code by changing the information recorded thereon. In systems with continuously changing users, the opening code for the locking device can thus be changed upon every change of user. In such a case, the only certainty required is that the reading device recognizes the code in effect at the time, which can be handled, for instance, by an update program. The updating of the code by the update program is effected upon each change in user. Such an arrangement could be achieved by having the updating automatically effected by the reading device or an electronic circuit of the lock so that expensive cable connections to a central unit can be dispensed with. The keys which are distributed are in this case provided with the code in effect at the time by a key dispensing unit.

In addition to, or as an alternative to this possibility of controlling the magnetic coil by means of the reading device, the invention provides that the tumbler associated with the magnetic coil be brought into a release position by the "normal" coding of the key—and therefore not by means of the supplementary code. In this way it is possible to make an emergency key which, in the event of the failure of the reading device or the like, nevertheless makes it possible to open the locking device. Such a failure could be caused, for instance, by disturbances in function or else by a power blackout. Depending on the nature of the supplementary code, the reading device is developed as an optical reading device or as a reading device provided with an induction magnetic head.

A further development of the invention is characterized by a housing which contains a slide which is displaceable by means of the magnetic key upon the correct coding and which, in its displaced position, moves the lock into the unlocked position. The magnetic key can in this case preferably be developed as a card provided with magnetic coding, which preferably bears the bar code on at least one flat side.

In accordance with a special embodiment, the slide is provided on its resting surface, which rests on an aperture plate fastened to the housing, with receiving recesses in which the tumblers, which are developed as magnetic pins displaceably lie, and that the holes of the hole plate are aligned with the receiving recesses in the basic position of the slide. The fundamental construction of this arrangement can be noted from European Patent Application No. 24 242, in which the locking device has an insertion slot for the magnetic card, the flat side of which comes to lie parallel to the hole plate upon its insertion. By inserting the magnetic card there, an armature plate is displaced, which prior to the insertion, had attracted the magnetic pins lying in the receiving recess and thereby displaced them in such a manner that they only partly lie within the receiving recesses and have a portion extending through the hole plate which is secured to the housing. In this condition, therefore, the slide cannot be brought into its displaced position. Only when the magnetic card has been introduced will the magnetic pins, in the case of correct card coding, be pushed back entirely into the receiving recesses due to the fact that identical magnetic poles of the card and corresponding magnetic pins are opposite each other, as a result of which the extension of the pins into the hole plate is eliminated. The slide can then be brought into the displaced position by the magnetic card, as a result of which, the lock is brought into its unlocked position. In accordance with one embodiment of the invention a part of the magnetic pins can form the base code by position, number and polarization while another part creates the supplementary code.

Preferably, it can be provided in this connection that at least one of the receiving recesses is contained in a magnetic pin support which is turnably mounted on the slide and can be fixed in given positions of rotation. The displacement of the magnetic pin support permits an additional change in the coding combinations.

For simple construction of the locking device and with respect to the use of at least one tumbler for the base code and/or the supplementary code it is provided that at least one of the receiving recesses is surrounded by the magnet coil. This receiving recess therefore contains the tumbler which can be controlled by the reading device upon the use of the normal key.

The objective of the invention is furthermore achieved by a locking device which consists of lock and magnetic key and has a housing in which there is contained a slide which is displaceable by means of the key moving the tumblers into the release position, the slide in its displaced position bringing the lock into the unlocked position, a reading device being provided which detects a supplementary code of the key and controls at least one additional tumbler which releases the slide.

In this connection, the additional tumbler may preferably be formed by a tumbler pin which is displaceable electromagnetically and which in the locking position engages a recess in the slide.

The locking device of the invention can be produced in a particularly simple manner with the use of already existing locks by providing an underhousing which can be placed on the lock housing and essentially contains the reading device and possibly the additional tumbler. Thus an existing lock can, by simple means, be converted into an object in accordance with the invention if the lock housing of the lock is fastened to the underhousing. In such a case it is only necessary that the reading sensor of the reading device, which is present essentially in the underhousing, is assured access to the key. The additional tumbler, which cooperates with the slide, is to be arranged in suitable manner in the lock housing and/or underhousing. This can be done, for instance, by creating an access channel to the slide within which channel the tumbler lies.

In order to protect the locking device of the invention from tampering, at least one receiving recess is provided, arranged on the side of the slide opposite the resting surface of the slide, the magnetic pin of that receiving recess cooperating in blocking position with a stop fastened on the housing. This measure is intended to prevent the unauthorized opening of the lock which, for instance, could be brought about by striking the lock housing with a hammer or the like so that the tumbler magnetic pins slide out of the holes of the hole insertion plate due to the vibrations. Such a displacement might take place simultaneously and in the same direction for all magnetic pins upon the hammering of the lock so that the additionally provided magnetic pin, in view of its position on the side of the slide facing the resting surface of the slide will emerge in part from the associated receiving recess and pass into engagement behind the stop fastened on the housing. In this way, displacement of the slide is prevented even if the other magnetic pins have left their interlock position due to the effect of the hammering.

As keys there can be provided key cards which can be classified as normal key cards and emergency key cards. In the case of the normal key card, which represents a specific card, its coding place associated with the special electromagnetically controlled tumbler is developed as a non-magnetic region. Therefore, with such a card, the special tumbler, surrounded by the magnetic coil, cannot be actuated by means of the base code. Rather this actuation must be effected by the supplementary code detected by the reading device and which by means of the energizing of magnetic coil transfers the corresponding tumbler into the release position.

In addition to such a specific normal code key there is provided a master emergency key card which is issued only to specially authorized persons. This emergency key card has a magnetic region on the coding place thereof which is associated with the electromagnetically controlled tumbler. Thus, by means of this magnetic region, upon the introduction of the emergency key into the lock it is possible to transfer into the release position also that tumbler which is normally displaceable only by the energizing of the magnetic coil. The magnetic region thus replaces the energizing of the magnetic coil, for instance in the event that an energizing of the magnetic coil is not possible because of a technical defect or a failure of current.

The locking device of the invention can be used in a system for the unsupervised monitoring of the use of the locking devices, particularly for lockers and/or authorization-dependent entrance regions or the like, for instance in bathing establishments, reading rooms, hotels or the like. In such a case the locking devices comprise a plurality of locks and an individual key card assigned to each user, the locks and key card being developed as stated above. In this connection, in accordance with the invention, specific locks which are to be locked with the base code of the card and master locks which are to be closed with the supplementary code or a combination of base code and supplementary code are provided. Specific locks can be used, for instance, on lockers. For entrance into authorization-requiring entrance regions it is, however, necessary to lock with the supplementary code or the combination of base code and supplementary code. The same is true of such a lock in the exit region of the entrance region, so that the entrance and exit control in this region is subjected to higher security than the use of the locker or the like.

Furthermore, it can be seen to it that the actuation of the master locks is reported to a detection unit. This detection unit preferably determines the number of lockings of the lock in question and/or the time of locking. By the recording of this data it is possible to check the time of stay of the user within the entrance region, which is necessary, for instance, in the case of time-limited use of a pool. Furthermore, the possibility of detection makes it possible to provide different services; thus it is possible, for instance, to activate a beverage vending machine by means of the device of the invention so that it dispenses a beverage. For this purpose, the card is introduced into an insertion slot in the beverage vending machine and the beverage removed. The beverage vending machine is provided with a master lock so that the removal of the beverage is reported to the detection unit. Upon leaving the entrance region a bill is then presented to the user covering the services which he has made use of, which, for instance, can be done by display of the amount of the bill on a screen. The drawing up of the bill is in this connection brought about by the introduction of the card into the display unit. Only after the user has inserted the proper amount of money in the display unit can the access region be left through a suitable lock-actuated barrier. Such a procedure is not limited to the dispensing of beverages but can, of course, also be used for other services, for instance for the use of hair dryers, sunlamps, payment of rental for beach umbrellas, etc.

Furthermore, in accordance with a further development of the invention, it is provided that in the event of a change of user the supplementary code be changed, the base code remaining the same. Thus it is not possible for the prior user to whom a very specific supplementary code was assigned, to leave a still unpaid bill to a subsequent user since the subsequent user receives a new and different supplementary code.

The arrangement can also be such that, before using the locking devices at the entrance to the access region, the user must already pay a certain amount of money, from which then, during the course of his stay and upon his utilization of certain services, the corresponding amount is deducted. Upon leaving the entrance region, the amount of money which has not been used is then paid back or additional payment is requested.

The entire system can operate automatically by the use of automated devices so that no cashier booths or the like which are occupied by actual persons are necessary.

In accordance with another further development of the invention an additional function is strived for. In the case of the locking device described above, there is the possibility of an unrecognized locking of the lock taking place by means of the emergency key although no emergency situation has arisen. This emergency situation is, for example, always present when the lock electronics are not operable, for instance because of failure of the power. The use of the emergency key should be reserved for these exceptional cases. In other words, this means that when the locking device is operable the locking is to be effected with the normal key while in case of a failure of the electronic system the emergency key is to be used, it permitting a purely mechanical, permanent-magnetic locking.

For this purpose, the locking device which consists of lock and key, has a housing within which there is contained a slide which is displaceable by means of a key which brings the tumblers into release position; in its displaced position the slide brings the lock into the unlocked position, the key bearing a base code which is developed as a magnetic code which displaces the tumblers on basis of magnetic forces, and with a reading device which detects a supplementary code of the key, said device electromagnetically controlling at least one additional tumbler, and with an emergency key, in particular for use when the lock electrical system is not operative, this emergency key having, in addition to the magnetic base code at the coding place thereof associated with the electromagnetically controlled tumbler, also a magnetic region for the tumbler displacement, a sensor of a monitoring circuit which checks the lock electronic system for operability and responds by bringing the slide into its displaced position being provided and the monitoring circuit, when the lock electronic system and emergency key operation are operable, giving off upon inquiry by the sensor, a signal which indicates the operating condition present. By means of the sensor of the invention, there is a possibility of monitoring the operating condition of the locking device. If the displacement of the slide takes place by means of the emergency key a signal will be given off even though the lock electronics is operable. The monitoring circuit gives off this signal if it finds that the lock electronics is ready for use and it receives the sensor signal on basis of the displacement of the slide, in which case it has additional information that the displacement of the slide has been effected by means of the emergency key. The knowledge that an emergency key has been used is obtained by the monitoring circuit on basis of the fact that a sensor signal is received which indicates a displacement of the slide, although the reader device has not noted any supplementary code. Thus the monitoring circuit is also connected to the reading device. Insofar as there is a failure of the lock electronics, such as present, for instance, upon a failure of the supply voltage or dead batteries, there occurs a displacement of the tumblers on the one hand via the magnetic forces of the base code developed as magnetic code and, on the other hand, via the magnetic action of the magnetic region of the emergency code which is present at the coding place associated with the electromagnetically controlled tumbler and accordingly leads, without the use of an electromagnet, to the corresponding displacement of the tumbler pin. In such an emergency-key housing no signal, or course, is given off by the monitoring circuit since said circuit is then inoperable. The absence of the signal is desired, in accordance with the invention, since then proper emergency-key operation is present, which requires no special report. In this way, assurance is had that the high intelligence of the locking device is not counteracted by the use, for instance, for reasons of convenience of, exclusively the emergency key rather than the key provided with the base code and the supplementary code. By the giving off of the signal by the monitoring circuit improper use of the emergency key can be noted and prevented by suitable measures.

In accordance with a further development of the invention, the signal is an acoustic alarm signal. Thus upon any misuse of the locking system an acoustic alarm is given off so that the misuse does not remain unnoted.

In addition, or as an alternative, to the giving off of an acoustic alarm signal it can be provided that, upon the occurrence of the signal, an additional bolt of the lock is brought into the locked position. If accordingly when such a misuse of the emergency key occurs the additional bolt which has been brought into the closed position prevents the opening of the object which is secured by the locking device. Only the key provided for the specific operating situation leads to an opening function in which neither the bolt or the like or the additional bolt of the locking device is brought into the locking position.

A good possibility of verification is present, in accordance with a further development of the invention, if the occurrence of the signal is recorded in a memory of the lock electronic system. By inquiry from the memory it can then be determined when and with what key a misuse was carried out. This is possible because, in addition to the storing of the signal, also other data can be noted, for example the code of the key used, which in its turn can refer to a given person, as well as the day and time of the use of the key.

The possibility of providing also a supplementary code in addition to the base code permits a very large number of lock combinations so that a very dependable device is created. The security and the field of use of this system can, however, in accordance with a further development of the invention be further increased thereby that special adaptation to the specific conditions of use is possible. For this purpose the locking device, which consists of lock and key, is provided with a housing within which there is contained a slide which is displaceable by means of the key which transfers tumblers into released position, the slide in its displaced position bringing the lock into the unlocked position, the key having a base code developed as magnetic code which displaces the tumblers on basis of magnetic forces and having a reading device which detects a supplementary code of the key and electromagnetically controls at least one additional tumbler, in which connection a special key provided with base and command codes is provided for the programming of the lock electronic system, the command code being noted by the reading device and the use of the special key, in addition to its giving of the command, leads to the shifting into release position of all tumblers, including the additional tumbler, and, in which connection, the programming commands are written in the memory of the lock electronics only upon activation of a sensor which responds by the bringing of the slide into its displaced position.

This development, which, in the same way as in the variant described above, comprises a sensor which responds in the displaced position of the slide makes possible, on basis of the programming possibility, a special field of use of the locking device. Depending on the programming effected, special functions can be realized. The transfer of the programming of the special key is possibly via special codings which are applied to the special key instead of or in addition to the "normal supplementary code." The basic coding of the special key corresponds to a normal key since, also in the case of special-key operation, assurance must be had that the tumblers which operate as permanent magnetics are brought into released position. The special code then comprises, on the one hand, the displacement of the additional tumbler to released position and, on the other hand, the command programming. As an alternative, a special key with command coding can be developed so that all tumblers including the additional tumbler are controlled via permanent magnets, which corresponds to an emergency key function, and that the programming take place via the special code detected by the reading device. In particular, the following programmings are possible:

"Authorization": After insertion of the command key, the locking device can now be actuated, for instance, only by means of the normal keys x, y and z, insofar as the keys x, y and z are inserted one after the other into the lock within a given period of time. The programming can, for instance, also be arranged in such a manner that two keys must be used one after the other in order to make it possible to bring the lock into the open position. The use of two keys can be employed for instance in banks in order to open doors which have double key security, i.e. the different keys of two different persons are necessary in order to open the door.

"Erase": This programming, which is also brought about by actuation by command key (special key) can, for instance, be used when a person has lost his normal key x. Via the "erase" function, the programming for the acceptance of the code of the normal key x for the opening function is then erased so that locking with the normal key x is no longer possible. Furthermore, it can be contemplated that, after the use of the special key for the "erase" programming, a replacement key can be inserted into the lock, the lock electronic system being thereby changed to the coding of the replacement key. This means that the replacement key is now imparted the lock function instead of the lost normal key x.

"Reset": This manner of operation, which can also be programmed by means of a special key, leads to the erasing of the program which has been loaded so that a new programming of the locking device is possible.

In accordance with a further development of the invention, it can be provided that the supplementary and/or command code is formed by a pattern of holes which pass through the key and can be detected by the optical reading device. Alternatively, however, the said code may also be a magnetic strip code which is scanned by an induction reading head of the reading device. As further variant it is possible to develop the said code as a bar code which can be read by the optical reading device.

The key, the normal key as well as the special key, is preferably developed in each case as a card.

In accordance with a special embodiment, the slide is provided on its resting surface which rests on a hole plate fastened to the housing with receiving recesses in which the tumblers, developed as magnetic pins, displaceably lie and that the holes of the hole plate are aligned with the receiving recesses in the basic position of the slide. In this connection, the locking device has an insertion slot for the key which is developed as a card, the flat side of the magnet card coming to rest parallel to the hole plate upon its insertion. By the insertion of the magnet card there is displaced an armature plate which, before the insertion, had attracted the magnetic pins lying in the receiving recesses and thus displaced them in such a manner that they now lie partly within the receiving recesses, a section thereof passing through the hole plate which is fastened to the housing. In this condition the slide cannot be brought into its displaced position. Only when the magnetic card is introduced are the magnetic pins, in the event of correct card coding, pressed entirely back into the receiving recesses by like magnet poles of card and corresponding magnetic pin facing each other, as a result of which the engagement into the hole plate is eliminated. Via the magnetic card, the slide can then be brought into the displaced position, as a result of which the lock is brought into its unlocked position. What has been described above applies to the base code, i.e. this code operates on the permanent-magnet principle. The additionally provided tumbler—several of which can also be present—is, in the case of a normal card, not shifted by a magnetic point of the card but by an electromagnetically operating device controlled by the supplementary code. As soon as the correct supplementary code has been detected by the reading device of the lock device, a coil which is arranged in the region of the additional tumbler is energized and causes displacement of the additional tumbler into release position. In the case of the emergency key card the displacement of the additional tumbler does not take place on basis of an electromagnetic excitation but also—as in the case of the base code—by means of a permanent-magnet excitation.

In accordance with a preferred embodiment of the invention, the sensor can be developed as an electric switch. The switch preferably consists of a microswitch the switch feeler of which cooperates with the slide.

BRIEF DESCRIPTION OF THE DRAWINGS

With the above and other objects and advantages in view, the present invention will become more clearly understood in connection with the detailed description of preferred embodiments, when considered with the accompanying drawings, of which.

DETAILED DESCRIPTION OF THE PREFERRED EMBODIMENTS

Figure 1:
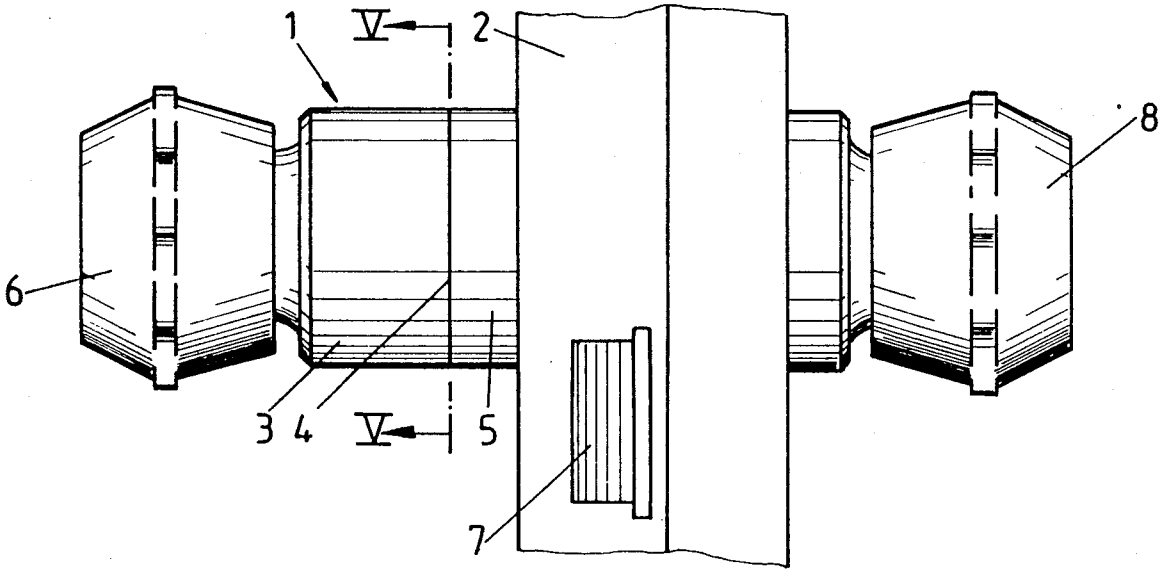
FIG. 1 shows a locking device mounted on a door.

Referring to FIG. 1, a lock 1 is mounted on a door 2 and has a lock housing 3 the bottom region 4 of which is placed on an underhousing 5. The underhousing 5 is, in its turn, fastened to the door 2. The lock housing 3 is provided with a turn knob 6 by means of which a latch 7 or a bolt (not shown) can be moved back if the lock 1 is in the unlocked position.

The turn knob 8 arranged on the other side of the door 2 is directly connected to the latch 7 or the bolt (not shown) so that it is always possible to open the door 2 from that side of the door. In hotel rooms the turn knob 8 is installed on the side of the door which is within the room while the lock housing 3, the underhousing 5 and the turn knob 6 are on the outside (hall side) of the door 2.

Figure 2:
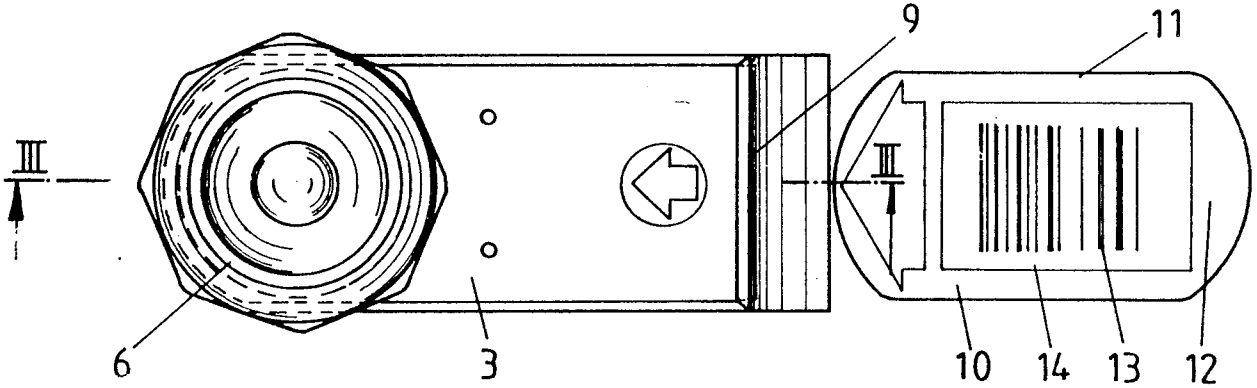
FIG. 2 is a top view of the locking device with magnet card, the flat side of which bears a bar code.

From FIG. 2 it is clear that the lock housing 3 is provided with an insertion slot 9 into which a key 10 can be inserted. The key 10 is developed as a card 11 provided with magnetic coding, the card bearing bar coding 13 on its flat side 12. The bar coding 13 can be applied to a label 14 which is glued onto the flat side 12 of the card 11. Alternatively, however, it is also possible for the bar coding 13 to be written permanently on the flat side 12 of the card 11.

Figure 3:
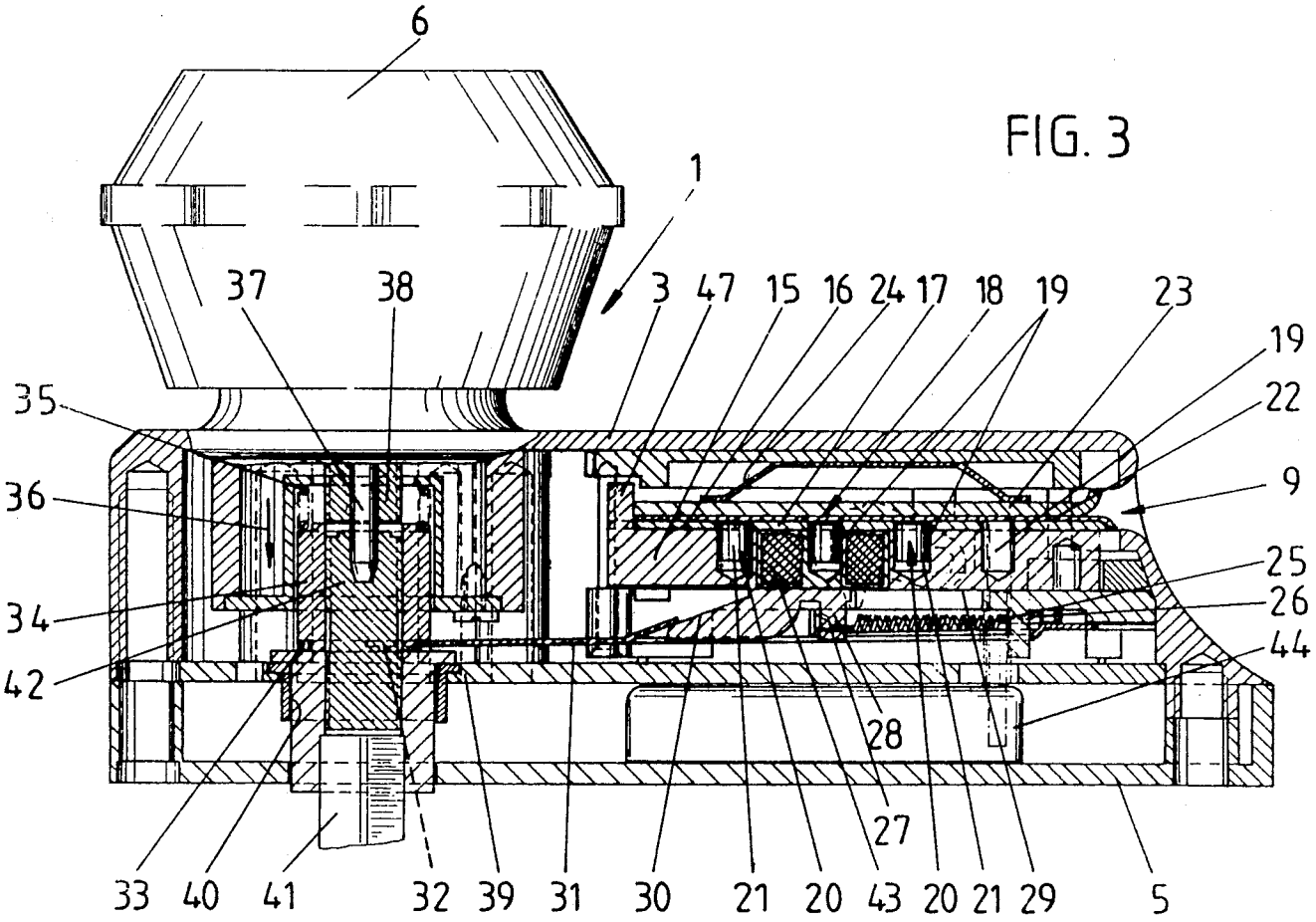
FIG. 3 is a longitudinal section along the line III—III of FIG. 2, the lock being in the locked position.

In accordance with FIG. 3, a slide 15 which is made in plate shape and having a resting surface 16 in which a hole plate 17 rests is supported within the lock housing 3. The holes 18 in the hole plate 17 are aligned in the locked position of the lock 1 shown in FIG. 3 with corresponding receiving recesses 19 of the slide 15 which extend from the resting surface 16 and are developed as blind holes. Tumblers 20 which are developed as magnetic pins 21 lie in the receiving recesses 19. The dimensions of the receiving recesses 19 are so selected that the magnetic pins can be displaced perpendicularly to the resting surface 16. As can be noted from FIG. 3, a magnetic pin 21 is not necessarily present in each receiving recess 19 since the number, position and polarity of the magnetic pins 21 depends on the specific opening-code combination of the lock 1.

On the hole plate 17 there lies a guide plate 22 on which an armature plate 23 is arranged. The armature plate 23 is held in position by a spring 24.

A tension spring 25 has its one end 26 fastened on the housing side and its other end 27 fastened on a projection 28 of the slide 15. Furthermore, on its side 29 opposite the resting surface, the slide 15 has a run-on bevel 30 which cooperates with a control plate 31. The control plate 31 lies with its fork-shaped end 32 on a shoulder 33 of a longitudinally displaceable coupling sleeve 34 which is urged by means of a coil compression spring 35 in the direction indicated by the arrow 36. The shaft 37 of the turn knob 6 penetrates into the inside of the lock housing 3 and has a gear 38 fastened fixed for rotation on the shaft. The toothing of the gear wheel 38 matches an inner toothing of the coupling sleeve 34. In the bottom 39 of the lock housing 3 a square 41 is mounted for rotation by means of a bearing bushing 40, the square having a gear wheel 42 on its end. The square 41 cooperates with a lever mechanism which is provided to pull the latch 4 or a bolt back.

In accordance with FIG. 3, one of the receiving recesses 19 is surrounded by a magnetic coil 43 which lies in a corresponding depression in the slide 15.

Adjoining the bottom 39 of the lock housing 3 is the underhousing 5 in which an optical reading device 44 as well as an electronic circuit (not shown in detail) are arranged. Furthermore, the underhousing 5 can also contain a source of current for the supplying of the electronic circuit as well as the reading device 44.

In the locked position of the lock 1, shown in FIG. 3, the gear wheel 38 which is coupled with the turn knob 6 does not engage into the corresponding mating toothing of the coupling sleeve 34 which is supported in longitudinally displaceable manner on the gear wheel 42 of the square 41. To this extent, there is no coupling between the turn knob 6 and the square 41, as a result of which the lock 1 assumes its locked position. By turning the turn knob 6 neither latch nor bolt can be actuated.

Figure 4:
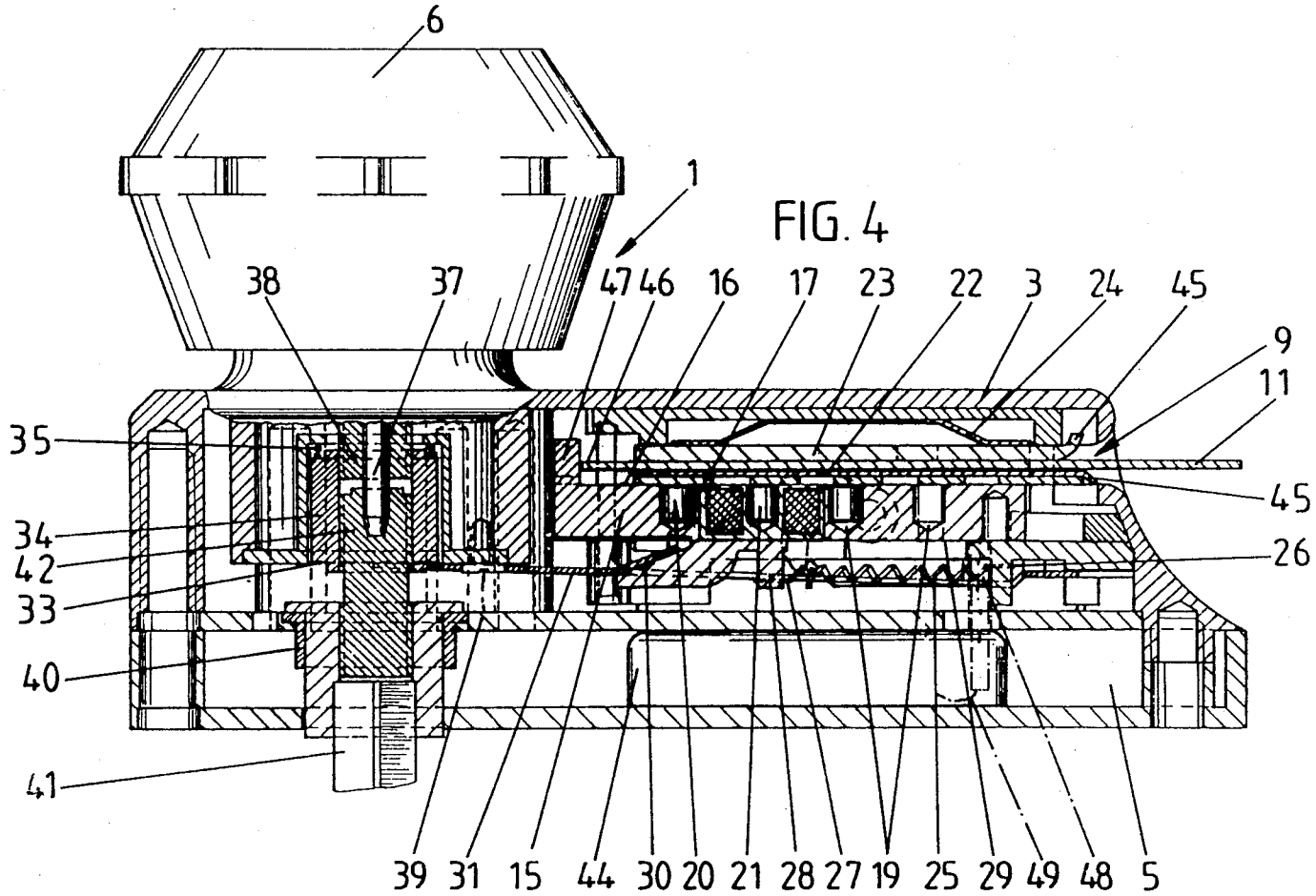
FIG. 4 is a longitudinal section in accordance with FIG. 3 but with the lock in the unlocked position.

FIG. 4 shows the lock 1 in its unlocked position, which can be brought about by inserting the card 11 into the insertion slot 8 in case the card 11 has the correct coding combination. The card 11 is in this case pushed between guide plate 22 and armature plate 23, the introduction being very readily possible due to suitable protrusions 45 on said elements. If one first of all again looks at FIG. 3 it is clear that when the card 11 is not inserted the magnetic pins 21 engage into the corresponding holes 18 of the hole plate 17 and rest with their end surfaces against the guide plate 22. This position of the magnetic pins 21 is produced by the armature plate 23 which, in contradistinction to the other structural parts, consists of ferromagnetic material. Thus, the armature plate 23 attracts the magnetic pins 21, as a result of which they assume the position described. In this position, the slide 15 cannot be pushed out of the basic position shown in FIG. 3 since the engagement of the magnetic pins 21 in the hole plate 17 which is fastened to the housing prevents this.

If one now, on the other hand, looks at FIG. 4, it can be seen that the magnetic pins 21 lie completely within their corresponding receiving recesses 19 and thus no longer form any form-lock with the hole plate 17. This comes about due to the fact that the magnetic coding present on the card acts in such a manner on the magnetic pins 21 that the latter are pressed back into the receiving recesses 19 by having poles of the same polarity facing each other. Upon the insertion of the card 11, the armature plate 23 can move away due to the spring 24. However, as soon as all magnetic pins 21 have been brought into release position after the insertion of the card 11, the slide 15 can, by additional pushing-in of the card 11, be brought, by the coming of the card end 46 against a slide stop 47, into the position shown in FIG. 4, as a result of which the run-on bevel 30 so acts on the control plate 31 that the end 32 of the latter pushes the coupling sleeve 34 in the direction opposite that of the arrow 36, as a result of which the inner toothing of the coupling sleeve 34 comes into engagement with the gear wheel 38. In this position, the turn knob 6 is thus coupled, fixed for rotation, with the square 41 so that the lock 1 assumes its unlocked position and actuation of the latch 7 or a bolt is possible.

In accordance with the invention it is provided that the magnetic pins 21 not surrounded by the magnetic coil 43 are brought by the base code of the card 11 into release position. The magnetic pin 21 which is surrounded by the magnet coil 43 passes into release position as a result of energization of the magnet coil 43. For this, the bar coding 13 is provided on the card 11—as previously described—this coding being optically scanned by a sensor 48 upon the pushing of the card 11 into the insertion slot 9. The sensor 48 is connected via a line 49 to the reading device 44, as a result of which the information which is read passes to the electronic circuit, which compares the coding read with the stored opening code of the lock 1. If there is agreement, then the magnet coil 43 is activated, as a result of which the corresponding magnetic pin 21 is brought into release position in accordance with FIG. 4.

As an alternative, however, it can also be provided that several magnetic pins 21 are surrounded with corresponding magnet coils 43.

For the creation of an emergency key, it is contemplated in accordance with another embodiment of the invention, that this emergency key, which also is developed as special card 11, is provided at the place thereof opposite the magnetic pin 21 which is provided with magnet coil 23, with a magnetic coding which produces a displacement of the magnetic pin 21 into the release position. Should the displacement of the magnetic pin 21 thus not be possible with the help of the magnet coil 43 due to a technical defect or power failure, this can also be done by means of the emergency key described above.

In accordance with a preferred embodiment of the key 10, it is provided that the bar code 13, is formed of a clock track and a data track, the two tracks extending parallel to each other. The result is thus obtained that upon the introduction of the card, the corresponding sensor 48 of the reading device 44 receives, via the time track, a reading pulse for the serial scanning of the data track. This system can be noted from Federal Republic of Germany Patent No. 2,431,497.

Figure 5:
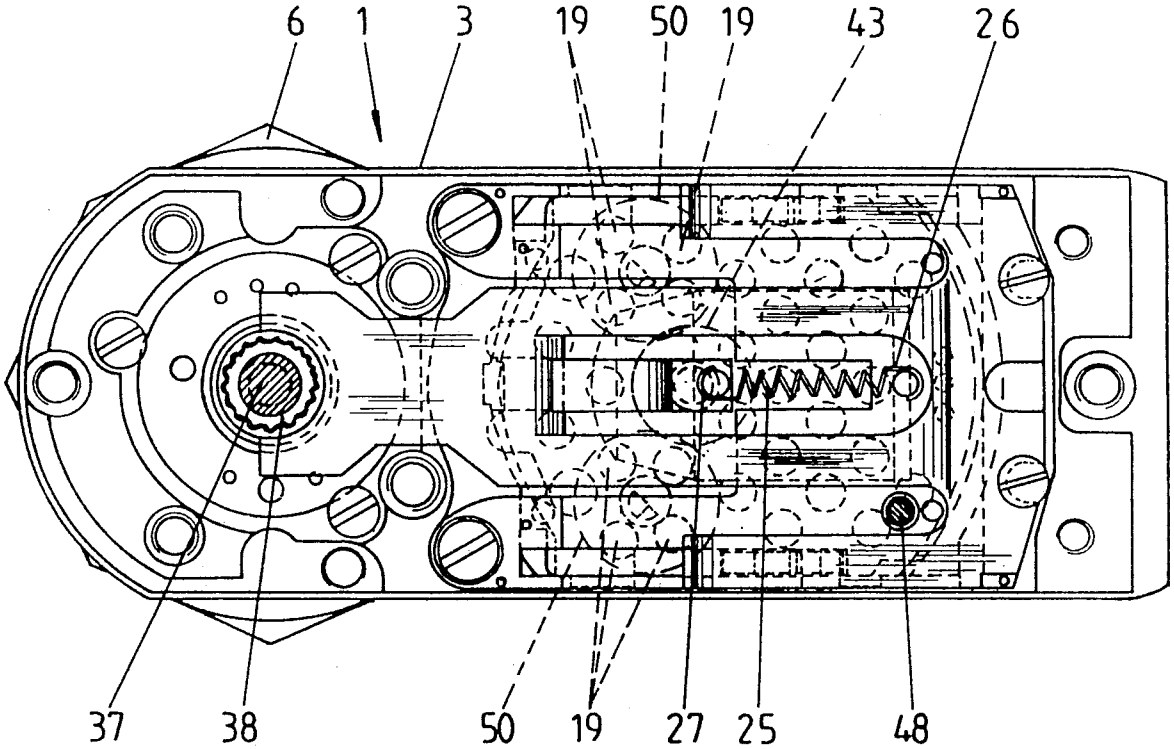
FIG. 5 is a section along the line V—V in FIG. 1, with the lock in the locked position.
Figure 6:
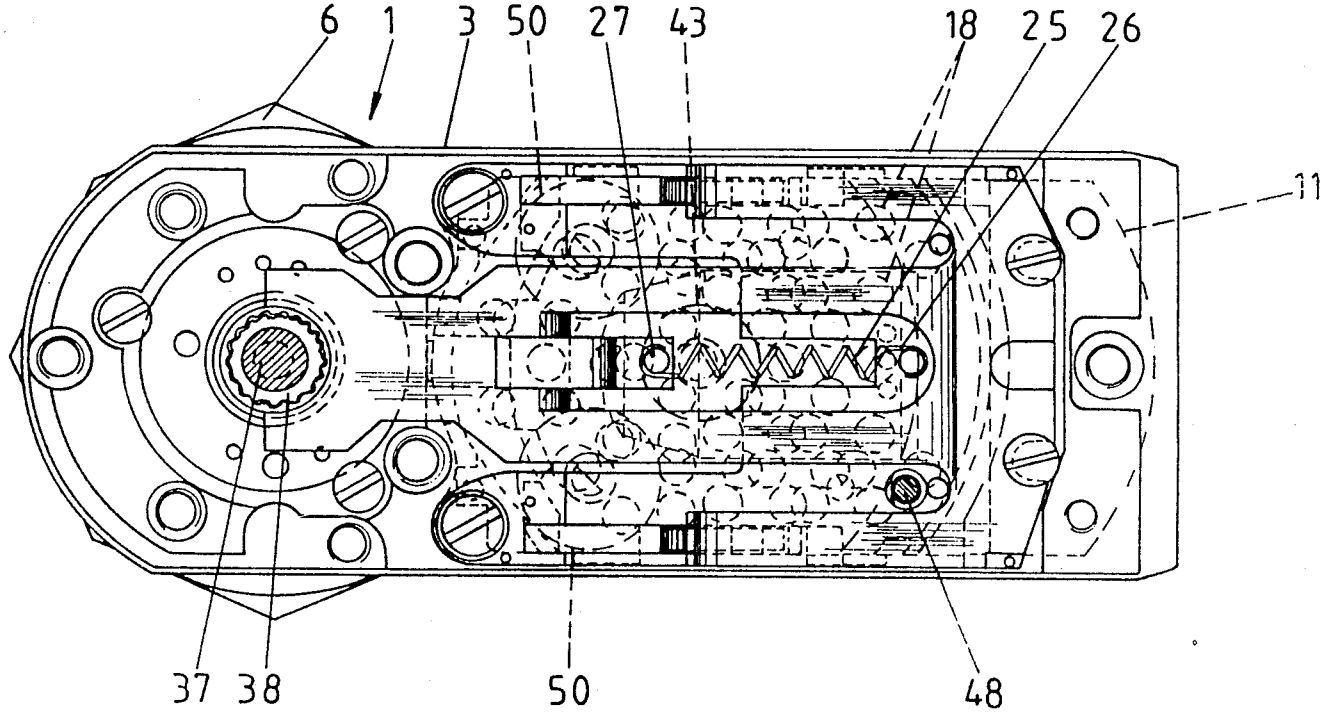
FIG. 6 is a section according to FIG. 5 but in the unlocked position.

In order further to increase the coding combination possibilities it is provided, in accordance with FIG. 5, that at least one of the receiving recesses 19 is arranged in a magnetic pin support 50 which is rotatably mounted on the slide 15 and can be locked fast in given positions of rotation. This magnetic pin support 50 can be turned by means of a special tool through openings in the lock housing 3, as a result of which the positions of the receiving recesses 19 can be changed. In this way a very fast reprogramming of the lock 1 can be effected. Two such magnetic pin supports 50 are preferably—as shown in FIG. 5—provided on the slide 15.

Figure 7:
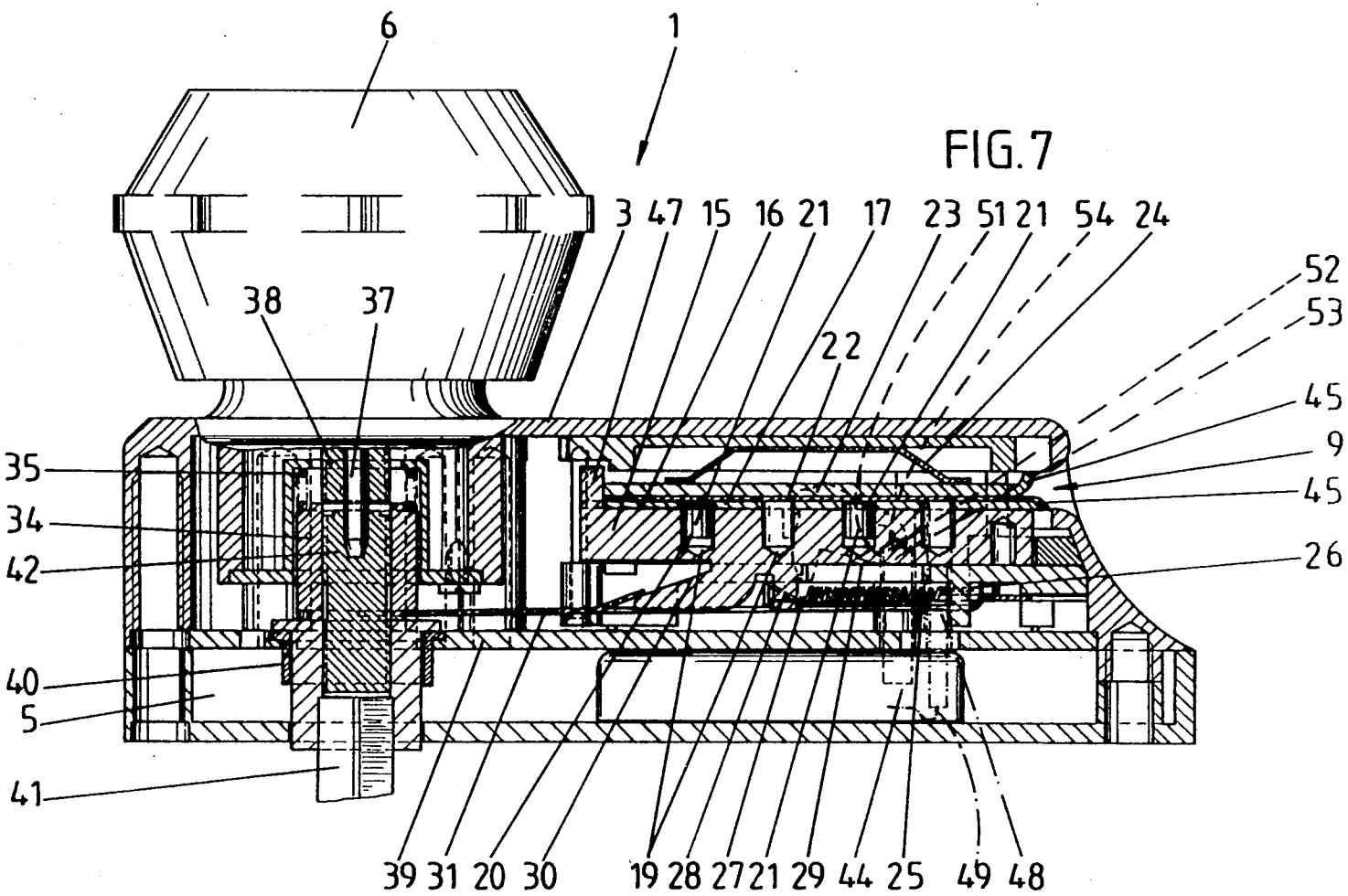
FIG. 7 is a longitudinal section through another embodiment of the lock, in the locked position.

FIG. 7 shows another embodiment of the locking device of the invention which differs from the embodiment previously described by the fact that no magnet coil 43 is present on the slide 15. Instead thereof, the following measures are taken: Starting from the reading device 44, a channel 51 is formed which extends up to the slide side 29 of the slide 15. Within this channel, there is arranged a tumbler 52 which can be developed as tumbler pin 53. The tumbler pin 53 can be displaced by means of an electromagnetic device (not shown), it entering, in locking position, into a recess 54 on the slide side 29 of the slide 15.

Figure 8:
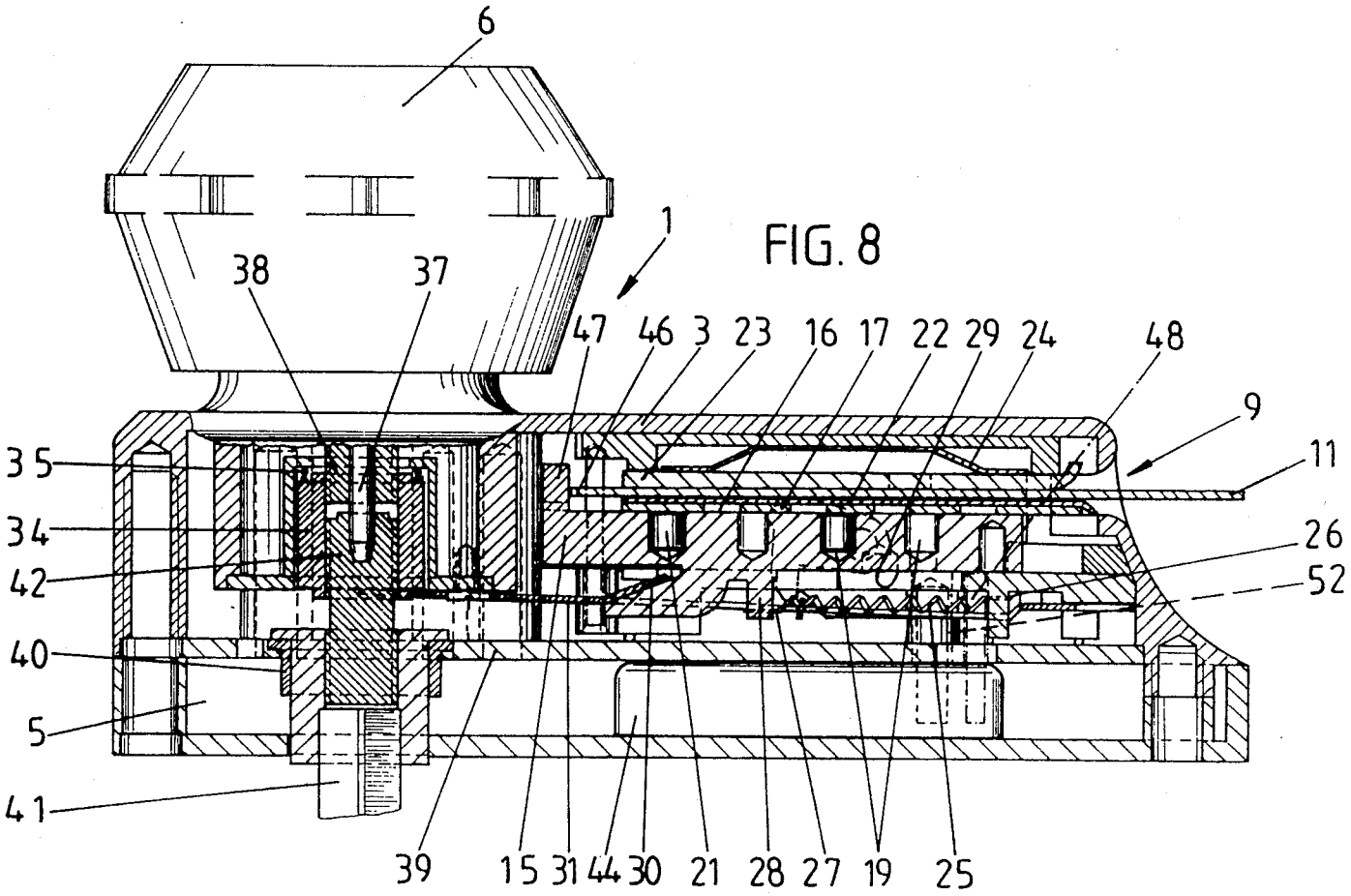
FIG. 8 is a longitudinal section according to FIG. 7, but in the unlocked position.

FIG. 7 shows the lock in locking position, in which, on the one hand, the magnetic pins 21 lie in the corresponding holes of the hole plate 17 and, on the other hand, the tumbler pin 53 engages into the recess 54. In this way, the slide 15 is held fast in its basic position. If the slide 15 is to be brought into the displaced position in which the lock 1 has its unlocked position then—in accordance with FIG. 8—the card 11 is inserted into the insertion slot 9, as a result of which—in the event of the correct coding—on the one hand the magnetic pins 21 are brought into release position and, on the other hand, the sensor 48 must have detected the correct bar coding so that the reading device 44 or the electronic circuit coupled with it shifts, via the electromagnetic device, the tumbler pin 53 downward so that it emerges from the recess 54. In this position then—as already described above—the slide 15 can be brought into its displaced position shown in FIG. 8 in which the coupling of the turn knob 6 with the square 41 then takes place.

Figure 9:
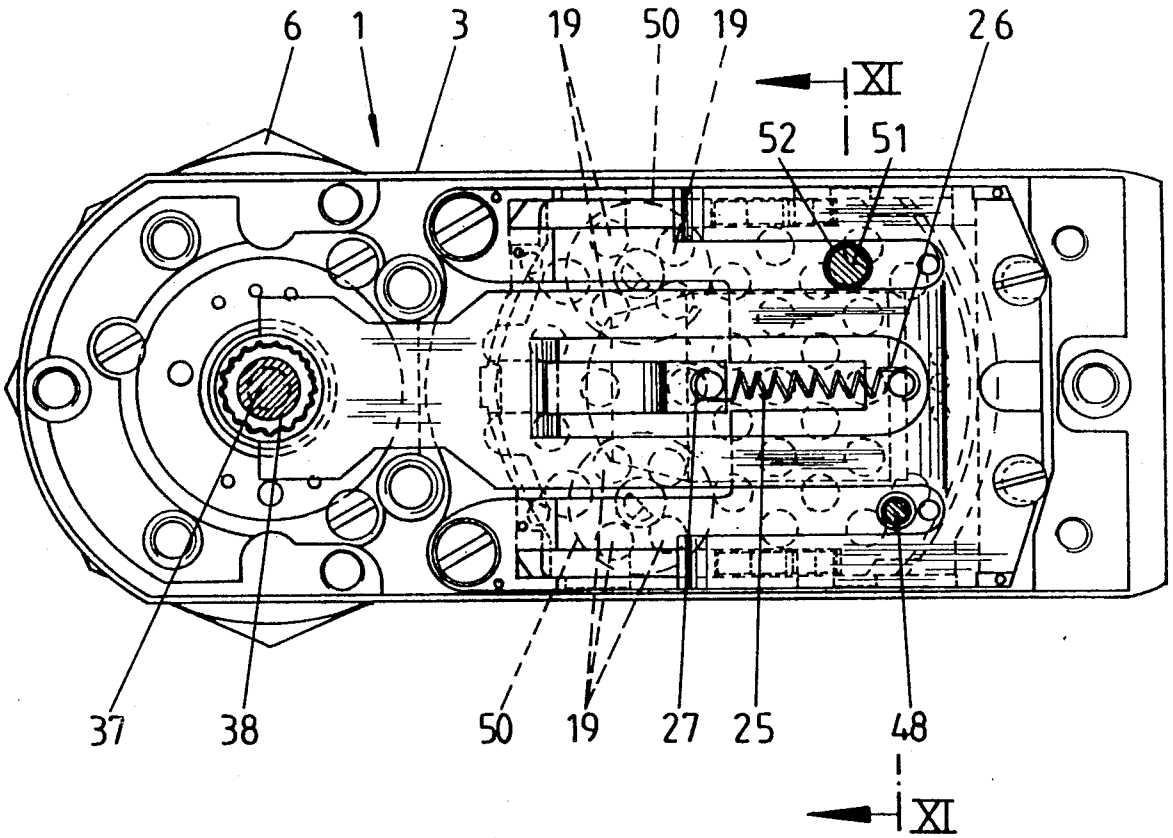
FIG. 9 is a bottom view of the lock in the locked position, with the bottom wall removed.
Figure 10:
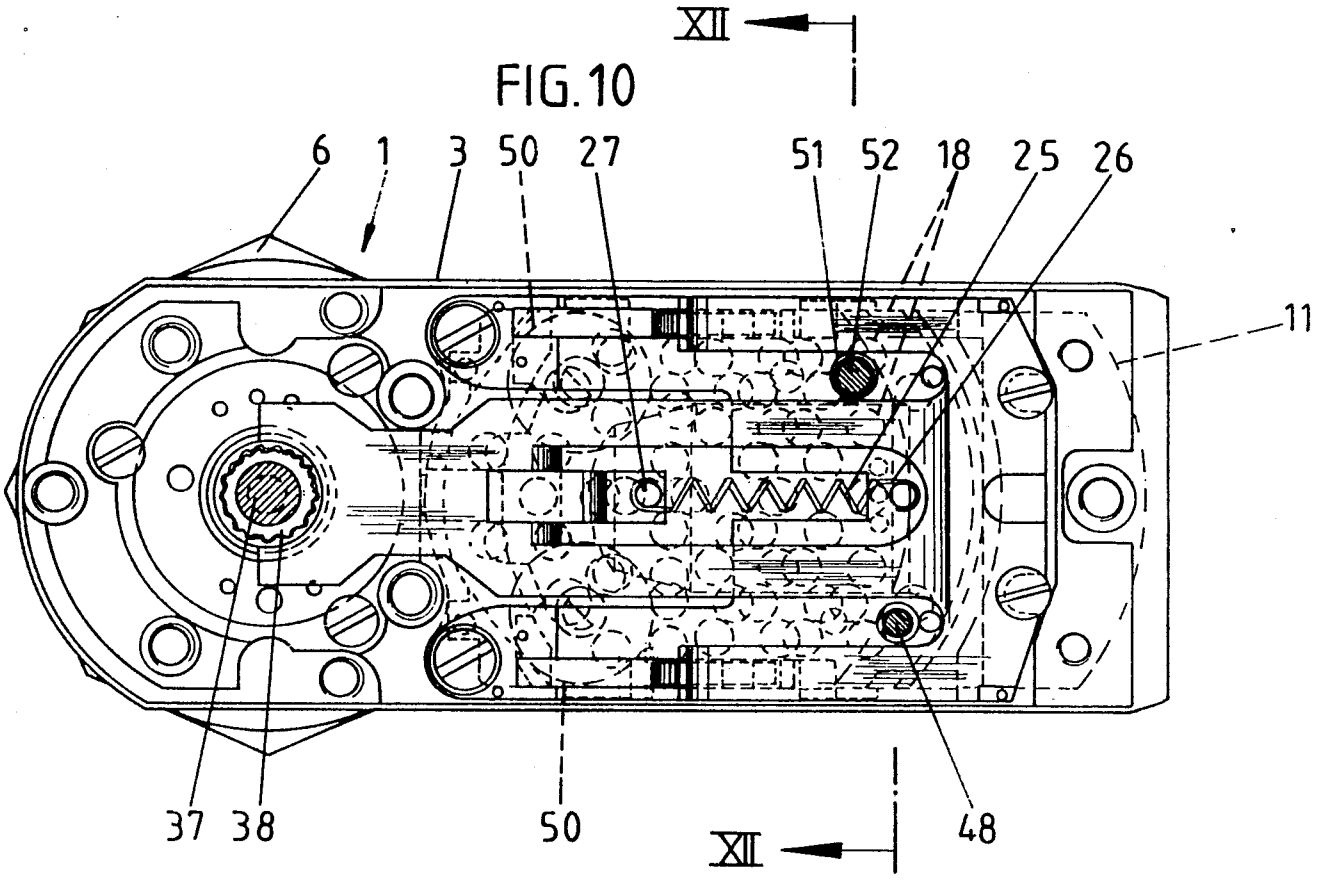
FIG. 10 is a view similar to FIG. 9, but with the lock in the unlocked position.

From FIGS. 9 and 10 it can be noted that the tumbler pin 53 is arranged in the one side region and the sensor 48 in the other side region of the slide 15. This arrangement is, however, not mandatory.

Figure 11:
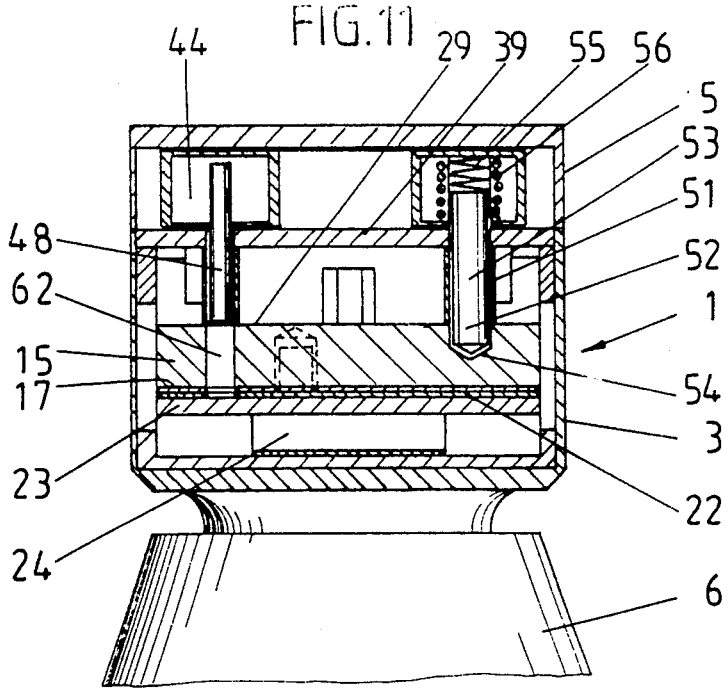
FIG. 11 is a cross section along the line XI—XI in FIG. 9.
Figure 12:
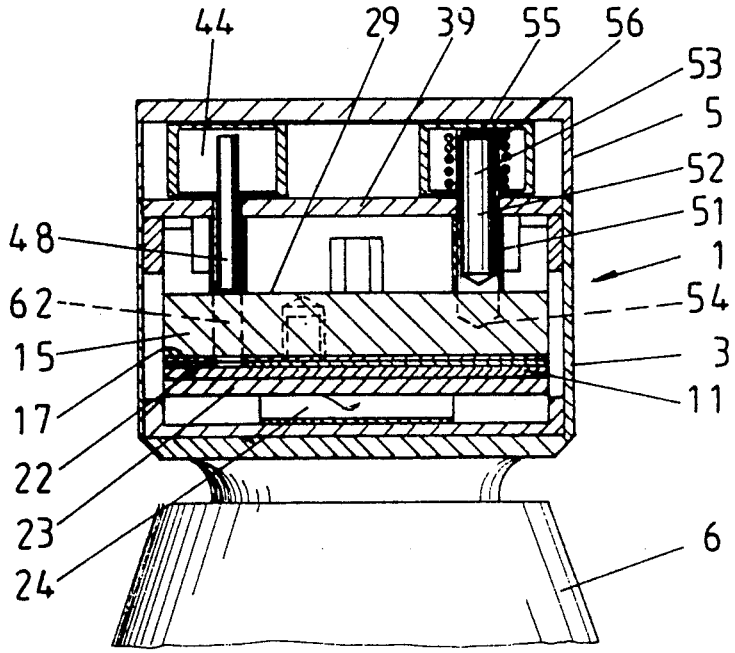
FIG. 12 is a cross section along the line XII—XII in FIG. 10.

The locked and unlocking positions can be noted particularly clearly from FIGS. 11 and 12 respectively. It is also clear from them that the tumbler pin 53 is urged by a coil compression spring 55 in the direction towards the slide 15. Furthermore, a coil 56 of the electromagnetic device for the displacement of the tumbler pin can be noted. It is furthermore clear that the slide 15, the hole plate 17 and the guide late 22 are passed through by a slot recess 62 so that the sensor 48 is imparted access to the bar coding 13 of the card 11.

Figure 13:
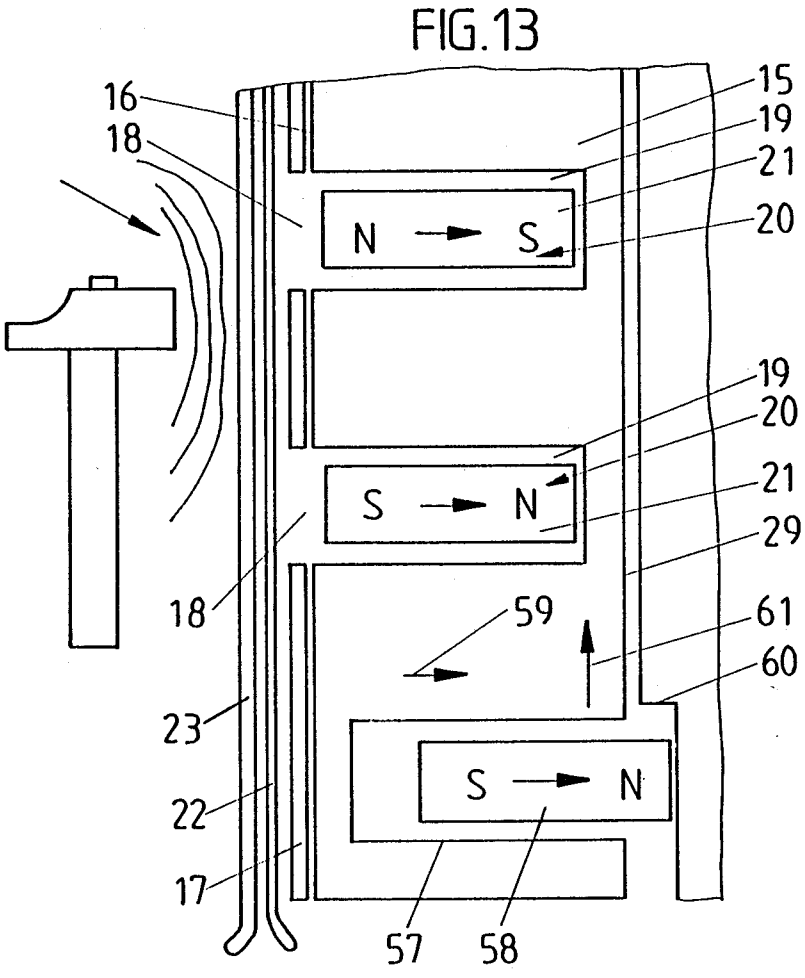
FIG. 13 is a diagrammatic sketch of the region of the slide of the lock upon manipulation by striking without magnetic card inserted.

FIG. 13 shows diagrammatically a portion of the slide region of the lock 1. It is shown that by striking the lock housing 3 a shifting of the magnetic pins 21 can take place in such a manner that they briefly enter into their corresponding receiving recesses 19 (see position in FIG. 13). At this moment a displacement of the slide 51 would be possible by means of a tool or the like inserted in the insertion slot so that the lock 1 could be unlocked. In order to prevent such unauthorized unlocking, there is provided on the slide side 29 opposite the resting surface 16 of the slide 15 a receiving recess 57 in which a magnetic pin 58 is displaceably contained. Since by the blow on the lock 1 all magnetic pins are deflected simultaneously in the same direction, the magnetic pin 58 as well as the magnetic pins 21 will move in the direction indicated by the arrow 59. In this connection the magnetic pin 58 enters into engagement behind a stop 60 on the housing. Thus displacement of the slide 15 in the direction of the arrow 61 is effectively prevented.

Figure 14:
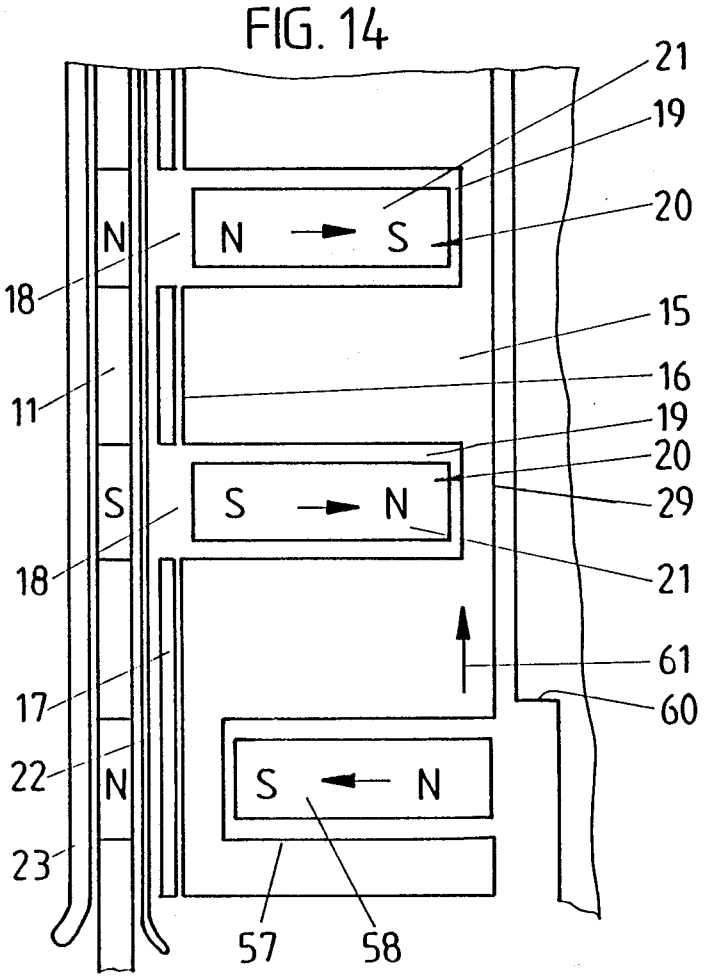
FIG. 14 is a diagram of the region of the slide of the lock with the magnetic card inserted.

In FIG. 14 the situation with the card 11 inserted is shown. It is clear herefrom that the magnetic pins 21 have completely entered into their corresponding receiving recesses 19 due to poles of the same polarity facing each other, while the complete entrance of the magnetic pin 58 is produced by the force of attraction of facing poles of opposite polarity. In the release position shown in FIG. 14 the slide 15 can be transferred into its displaced position.

The object of the invention affords increased system security by an electronic system which operates in addition to the mechanical system (magnetic) and effects a locking or unlocking function by reading an optical code.

The optical code can be applied by imprinting or pasting an adhesive label on the key (also temporarily). A key modified in this manner affords a higher standard of security, particularly in areas of controlled access.

Furthermore, an existing mechanical system can be modified with the aid of the optical electronic solution of the invention as a result of which the advantages described at the start are obtained.

The key of the locking device developed as a card in accordance with the invention has, distributed at different places on its flat side, magnetic regions which cooperate with the tumblers. In this connection, it is possible in accordance with one embodiment for these regions to form the basic code. Furthermore, one or more of these regions can be used for the above-described emergency-key function. The supplementary code of the key of the invention is formed by a bar code arranged on the flat side and/or holes passing through the card and/or a magnetic strip applied to the flat side of the card or embedded in it. In this connection, it is also possible for the supplementary code to comprise one or more of the magnetic regions described above. In accordance with one special embodiment, the basic code can be formed by one part of the magnetic regions and the supplementary code by another part of the magnetic regions.

The magnetic regions can differ with respect to their polarity (north pole and south pole). The magnetic pins of the tumblers must be developed accordingly.

The detection of the holes which pass through the key card and which are arranged distributed at different places over the flat side of the card in the corresponding version of the key is effected via suitable sensors of the reading device. In this connection the reading—as in the case also of all other types of coding previously described—can be divided into a clock track and an information track.

Figure 15:
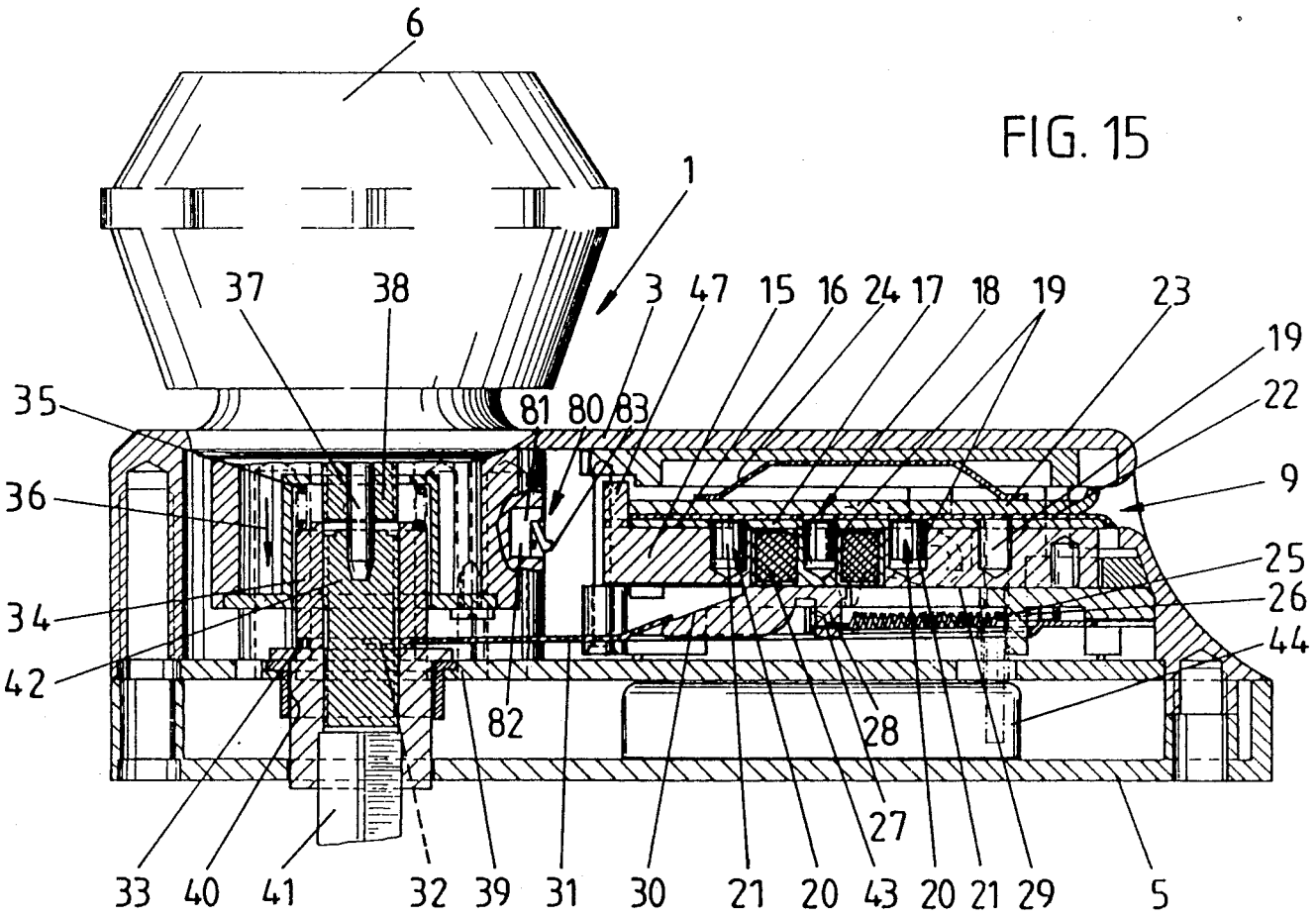
FIG. 15 is a longitudinal section through another embodiment of the locking device, the lock being in the locked position.

In the embodiment shown in FIG. 15, the lock 1 is provided with a lock housing 3 the bottom region of which is placed on an underhousing 5. The lock housing 3 is provided with a turn knob 6 by means of which a latch, not shown, or bolt can be pulled back if the lock 1 is in the unlocked position. The embodiment shown corresponds, in principle, to the construction of the lock which has already been described. Here, once again, are the most essential features:

As already described above, the lock housing 3 is provided with an insertion slot 9 into which a key 10 can be inserted. The key 10 is developed as a card 11 provided with magnetic coding and bearing bar code 13 on its flat side 12.

Within the lock housing 3 there is mounted a slide 15 which is of plate shape and on the resting surface 16 of which there rests a hole plate 17. The holes 18 in the hole plate 17 are aligned in the locking position of the lock 1 shown in FIG. 15 with corresponding receiving recesses 19 of the slide 15 which extend from the resting surface 16 and are developed as blind holes. Within the receiving recesses 19 there lie tumblers 20 which are developed as magnetic pins 21. The dimensions of the receiving recesses 19 are so selected that the magnetic pins 21 can be displaced perpendicular to the resting surface 16. As can be noted from FIG. 15, a magnetic pin 21 is not necessarily present in every receiving recess 19 since the number, position and polarity of the magnetic pins 21 depends on the specific opening-code combination of the lock 1. On the hole plate 17 there lies a guide plate 22 on which an armature plate 23 is arranged. The armature plate 23 is held in position by a spring 24.

A tension spring 25 has its one end 26 fastened to the housing while its other end 27 is attached to a projection 28 on the slide 15. Furthermore, the slide 15 has a run-on bevel 30 on the side 29 thereof opposite the resting surface, said bevel cooperating with a control plate 31. The control plate 31 has its fork-shaped end 32 lying on a shoulder 33 of a longitudinally displaceable coupling sleeve 34 which is urged in the direction of the arrow 36 by a coil compression spring 35. The shaft 37 of the turn knob 6 extends into the inside of the lock housing 3 and has a gear wheel 38 arranged fixed for rotation on it. In this connection, the toothing of the gear wheel 38 is adapted to an internal toothing of the coupling sleeve 34. In the bottom 39 of the lock housing 3 a square 41 is turnably mounted by a bearing bushing 40, the square having a gear wheel 42 on its end. The square 41 cooperates with a lever mechanism which is provided for the pulling back of a latch (not shown) or a bolt (not shown).

In accordance with FIG. 15, one of the receiving recesses 19 is surrounded by a magnet coil 43 which rests in a corresponding depression in the slide 15.

Adjoining the bottom 39 of the lock housing 3 is the underhousing 5 in which an optical reading device 44 and an electronic circuit (not shown in detail) are arranged. Furthermore, the underhousing 5 can also contain a source of current for the supplying of the electronic circuit and the reading device 44. As an alternative, however, an energy feed can also be provided via a power-line cable—possibly with the interposition of a transformer and a rectifier.

In the locked position of the lock 1 shown in FIG. 15 the gear wheel 38 coupled with the turning knob 6 does not engage in the corresponding mating toothing of the coupling sleeve 34 which is mounted for longitudinal displacement on the gear rim 42 of the square 41. To this extent there is no coupling between the turn knob 6 and the square 41, a result of which the lock 1 assumes its locked position. By turning the turn knob 6 neither latch nor bolt can be actuated.

Figure 16:
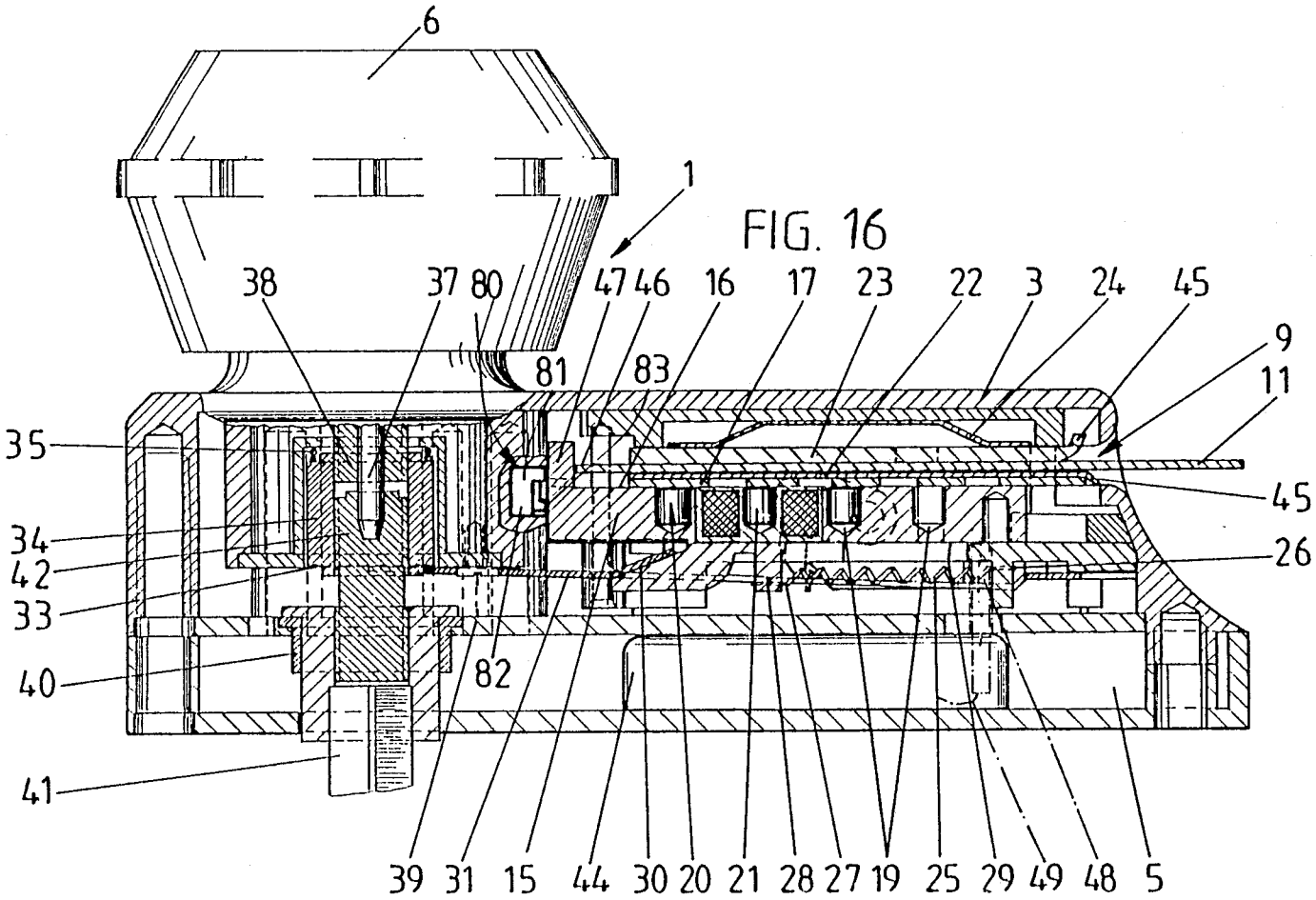
FIG. 16 is a longitudinal section according to FIG. 15, but with the lock in the unlocked position.

FIG. 16 shows the lock 1 in its unlocked position, which can be obtained by pushing the card 11 into the insertion slot 9 in the event of the proper coding combination of the card 11. The card 11 is in this connection pushed between guide plate 22 and armature plate 23, the introduction being very easy due to corresponding bent portions 45 of these parts. If one, first of all, again examines FIG. 15 it is clear that when the card 11 is not inserted the magnetic pins 21 engage into the corresponding holes 18 of the hole plate 17 and rest with their end surfaces against the guide sheet 22. This position of the magnetic pins 21 is produced by the armature plate 23 which, in contradistinction to the other parts, consists of ferromagnetic material. Thus the armature plate attracts the magnetic pins 21, as a result of which they assume the position described. In this position the slide 15 cannot be pushed out of its basic position shown in FIG. 15 since the engagement of the magnetic pins 21 in the hole plate 17 which is fastened to the housing prevents this.

However, if one considers, in contradistinction to this, FIG. 16 then it is clear that the magnetic pins 21 lie completely in their corresponding receiving recesses 19 and thus no longer form a form-lock with the hole plate 17. This is brought about in the manner that the magnetic coding present on the card acts in such a manner on the magnetic pins 21 that the latter are pushed back into the receiving recesses 19 by poles of the same polarity being opposite each other. Upon the insertion of the card 11, the armature plate 23 can move away as a result of the spring 24. As soon, however, as all magnetic pins 21 have been brought into the release position after the insertion of the card 11, the slide 15 can, by further pushing-in of the card 11, be brought into the position shown in FIG. 16 by the resting of the card end 46 against a slide stop 47 as a result of which the run-on bevel 30 so acts on the control plate 31 that its end 32 pushes the coupling sleeve 34 in direction opposite the direction of the arrow 36 as a result of which the inner toothing of the coupling sleeve 34 comes into engagement with the gear wheel 38. In this position, thus, the turn knob 6 is coupled, fixed for rotation, with the square 41 so that the lock 1 assumes its unlocked position and actuation of the latch or bolt is possible.

The arrangement in this connection is such that the magnetic pins 21 not surrounded by the magnet coil 43 are brought into release position by means of the base code of the card 11. The magnetic pin 21 which is surrounded by the magnet coil 43 passes, by excitation of the magnetic coil 43, into the release position. For this purpose, the bar coding 13 is provided on the card 11—as previously described—the coding being optically scanned by means of a sensor 48 upon the pushing of the card 11 into the insertion slot 9. The sensor 48 is connected via a line 49 to the reading device 44, as a result of which the information which is read arrives at the electronic circuit which compares the coding read with the stored opening code of the lock 1. If there is agreement, then the magnet coil 43 is energized, as a result of which the corresponding magnetic pin 21 is brought into the release position shown in FIG. 16.

In accordance with a further development, not shown in the drawing, it can, however, also be provided that a plurality of magnetic pins 21 are surrounded by corresponding magnet coils 43.

In order to create an emergency key it is contemplated, in accordance with another embodiment, that this emergency key, which is also developed as special card 11, be provided, on the place thereof opposite the magnetic pin 21 provided with magnet coil 43, with a magnetic coding which effects a shifting of the pin 21 into release position. Should the displacement of the magnetic pin 21 thus not be possible by means of the magnet coil 43 as a result of a technical defect—for instance power failure—this can also be done with the aid of the emergency key described previously.

Figure 17:
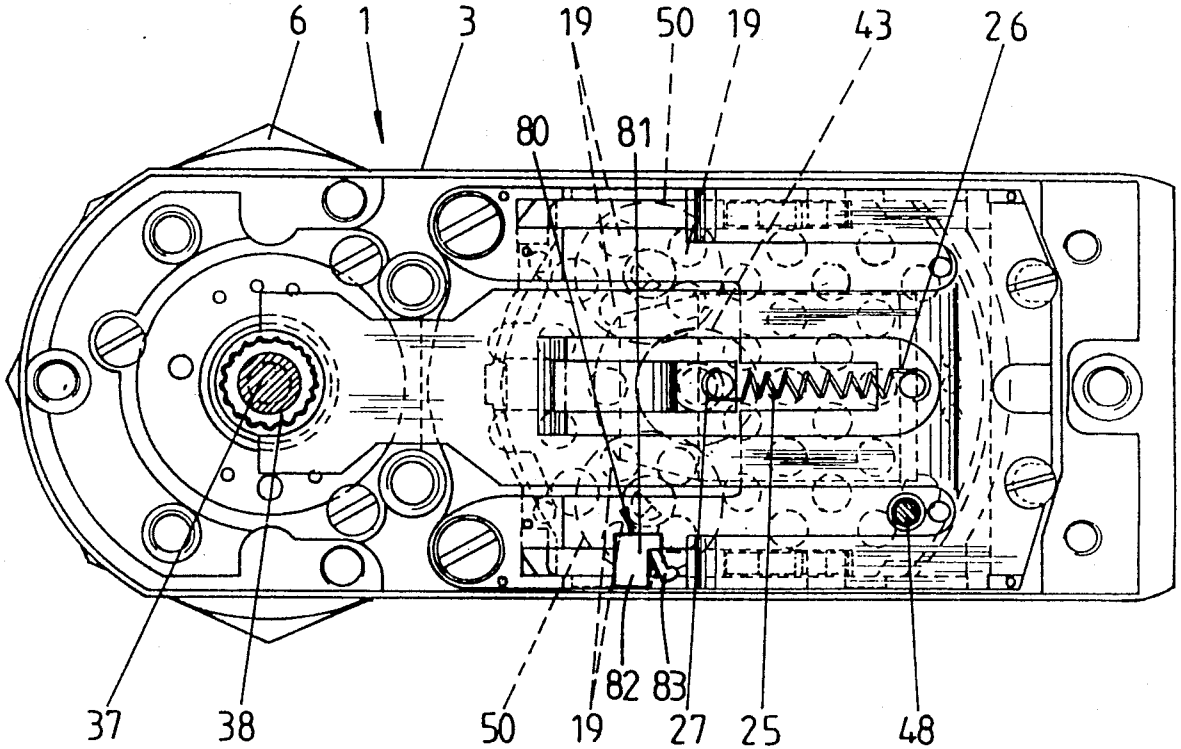
FIG. 17 is a bottom view of the lock with the bottom of the lock removed, the lock being in the locked position.

In order further to increase the coding-combination possibilities it is contemplated, in accordance with FIG. 17, that at least one of the receiving recesses 19 be arranged on a magnetic pin support 50 which is rotatably mounted on the slide 15 and can be locked fast in given positions of rotation. This magnetic pin support can be turned by means of a special tool through openings in the lock housing 3, as a result of which the positions of the receiving recesses 19 can be changed. In this way a very rapid reprogramming of the lock 1 can be effected. Preferably two such magnetic pin supports (as shown in FIG. 17) are present on the slide 15.

Figure 18:
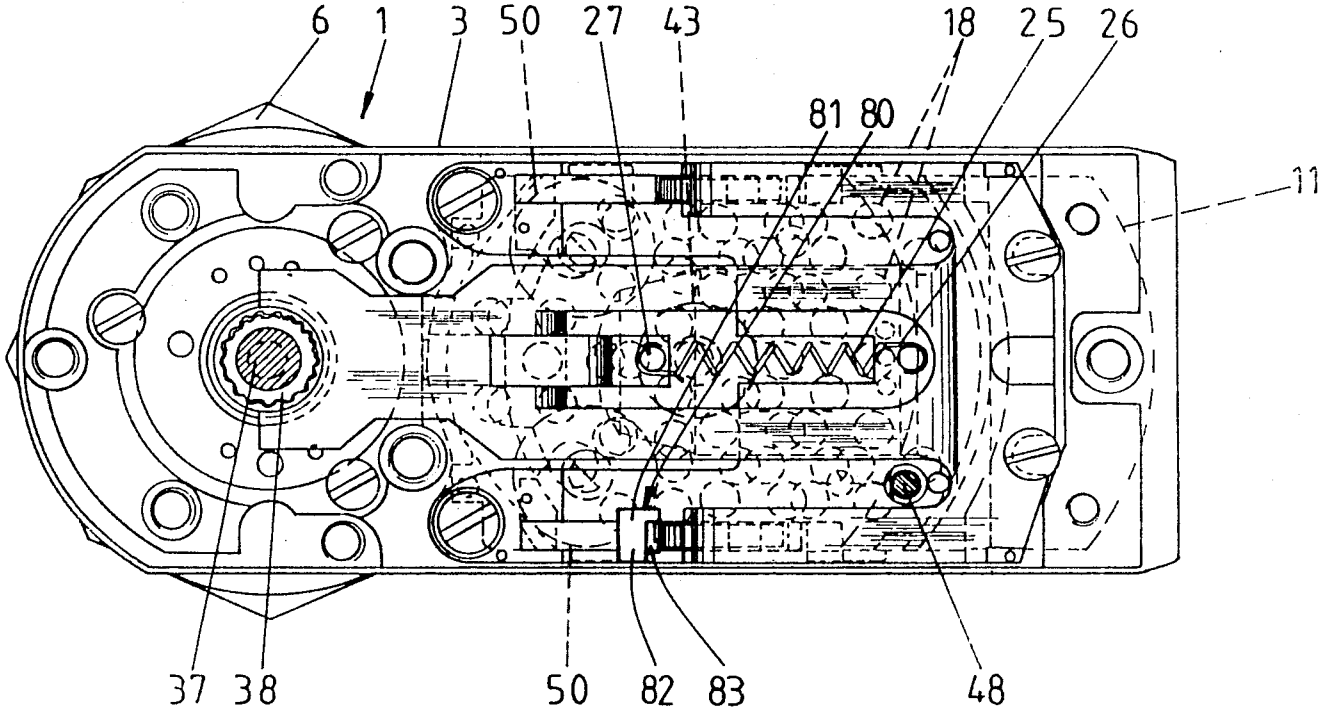
FIG. 18 is a view similar to FIG. 17, but in the unlocked position.

FIG. 18 corresponds to the showing of FIG. 17, the lock, however, being in the unlocked position.

Figure 19:
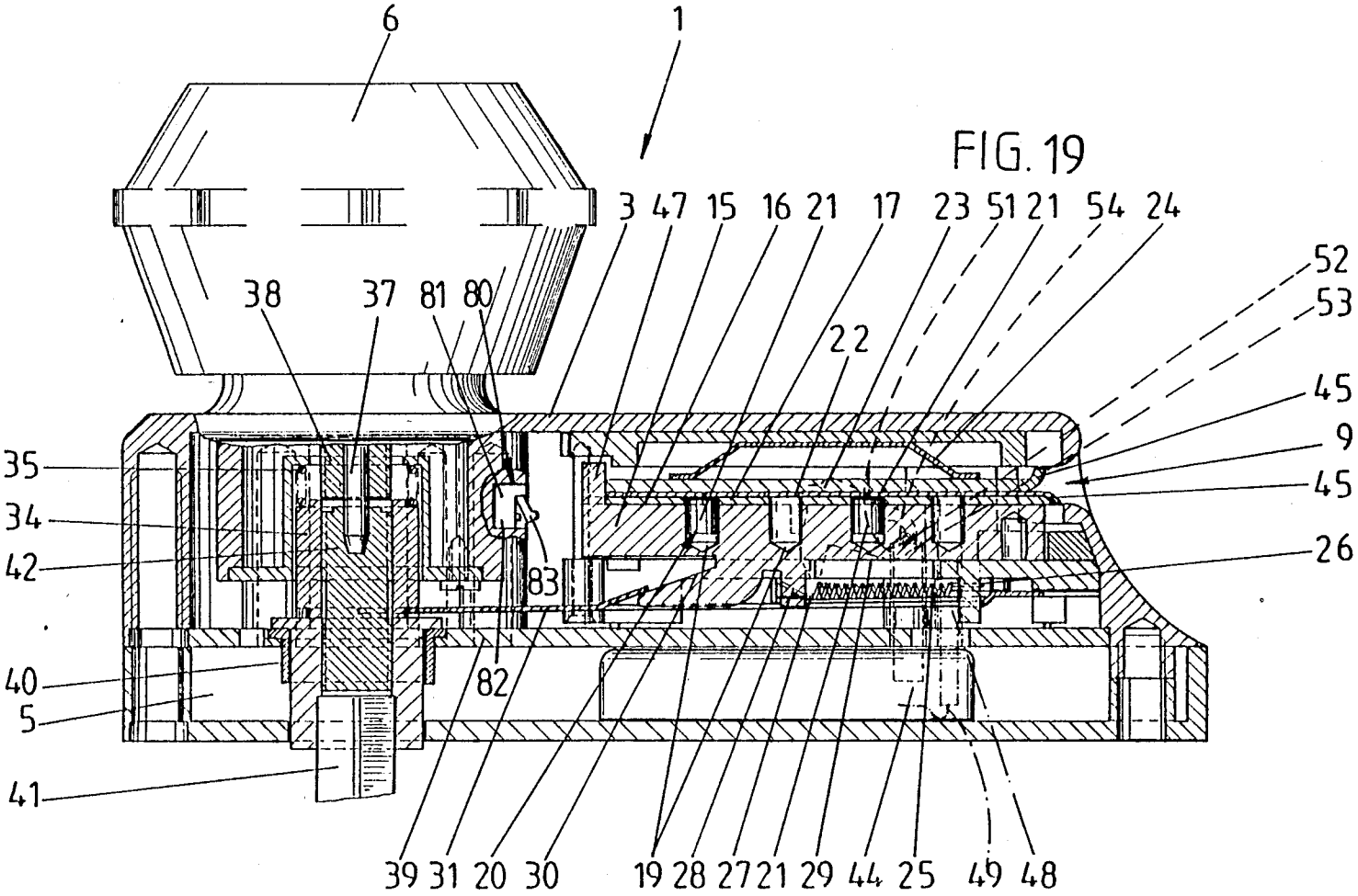
FIG. 19 is a longitudinal section through another embodiment of the lock, in the locked position.

FIG. 19 shows another embodiment of the locking device of the invention which differs from the embodiment previously shown by the fact that no magnetic coil 43 is present on the slide 15. Instead of this, the following measure is taken: Starting from the reading device 44, a channel 51 is formed which extends up to the slide side 29 of the slide 15. Within this channel, there is arranged a tumbler 52 which can be developed as tumbler pin 53. The tumbler pin 53 can be shifted by means of an electromagnetic device, not shown in the drawing, it entering, in locking position, into a recess 54 on the slide side 29 of the slide 15.

FIG. 19 shows the lock in locked position, in which, on the one hand, the magnetic pins 21 lie in the corresponding holes of the hole plate 17 and, on the other hand, the tumbler pin 53 engages into the recess 54. In this way, the slide 15 is fixed in its basic position. If the slide 15 is to be brought into displaced position in which the lock 1 has its unlocked position, then—in accordance with FIG. 20—the card 11 must be pushed into the insertion slot 9, as a result of which—in the event of proper coding—on the one hand, the magnetic pins 21 are brought into release position and, on the other hand, the sensor 48 must have detected the correct bar coding so that the reading device 44 and/or the electronic circuit coupled with it shifts, via the electronic device, the tumbler pin 53 downward so that it emerges from the recess 54. In this position—as already described above—the slide 15 can be brought into its displaced position, shown in FIG. 20, in which the coupling of the turn knob 6 with the square 41 then takes place.

Figure 21:
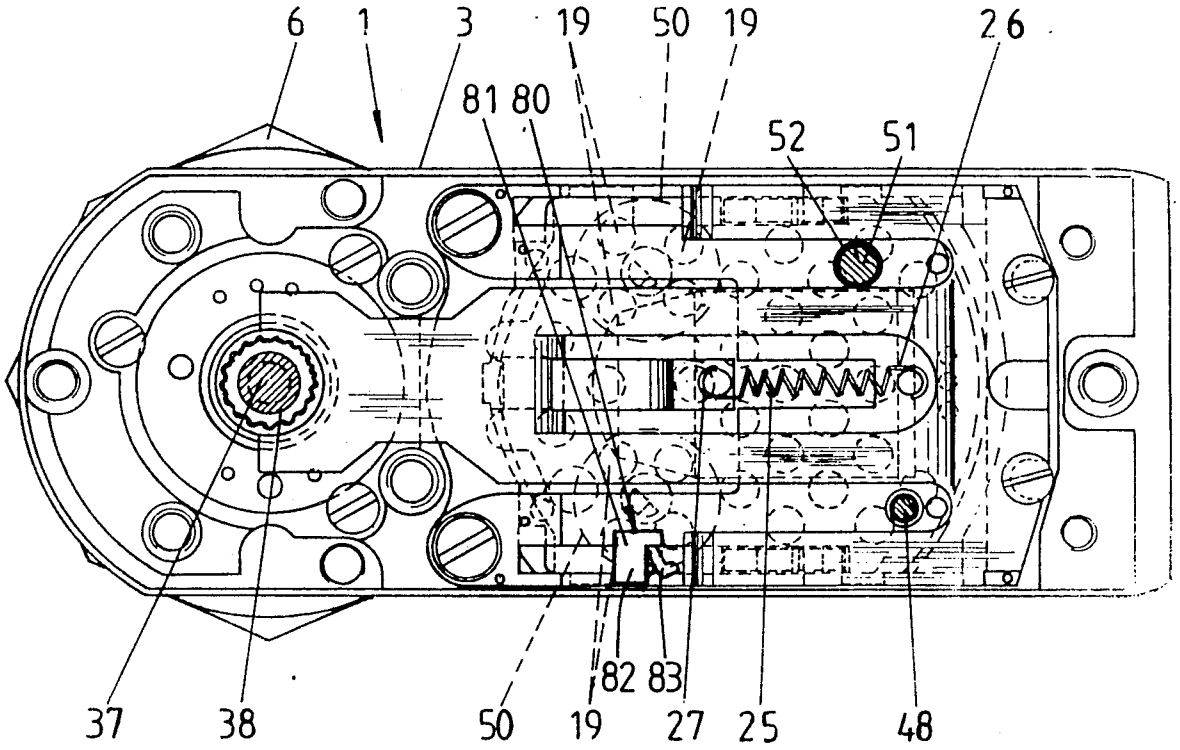
FIG. 21 is a bottom view of the lock in the locked position with the bottom wall removed.
Figure 22:
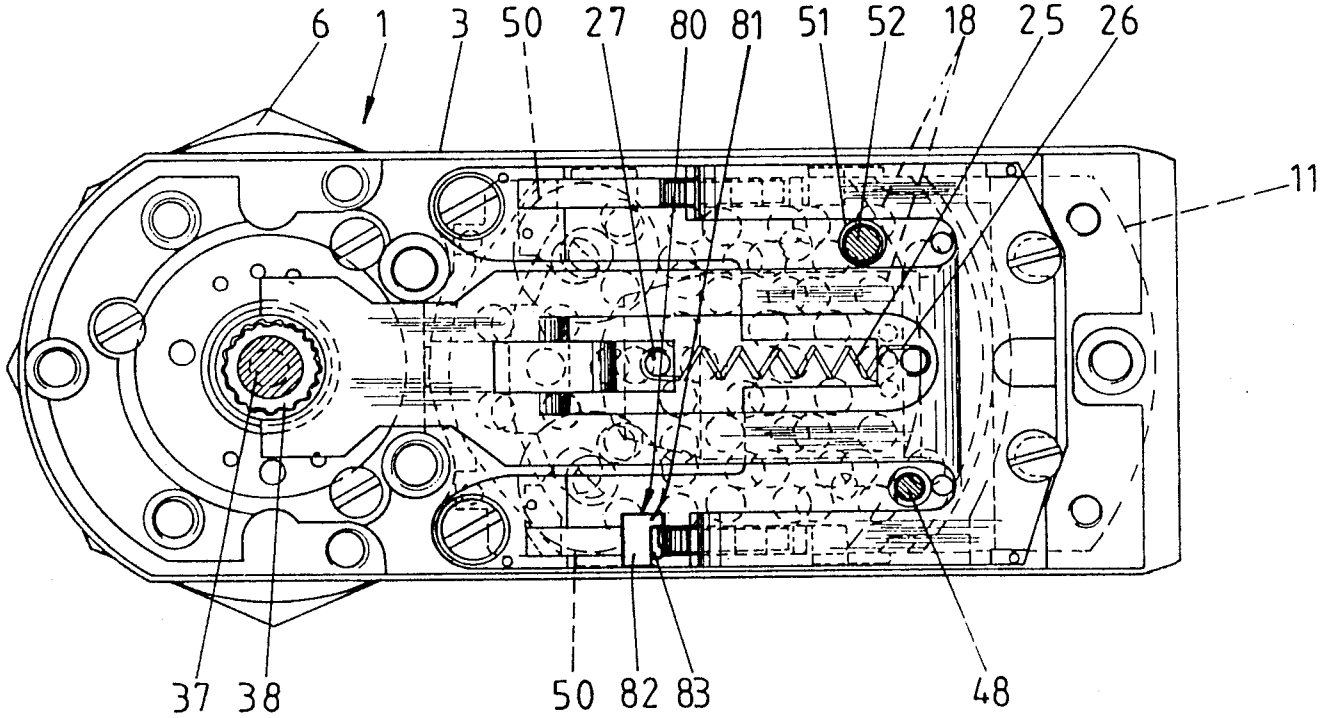
FIG. 22 is a view according to FIG. 21 but in the unlocked position of the lock.

From FIGS. 21 and 22 it can be noted that the tumbler pin 53 is arranged in the one side region of the slide 15 and the sensor 48 in the other side region of the slide 15. This arrangement is, however, not mandatory.

In accordance with the invention, in all the embodiments described above in FIGS. 15 to 22 the slide 15 cooperates with a sensor 80. The sensor 80 is preferably developed as electric switch 81. In particular, it can be developed as a microswitch 82 which has a swingably mounted switch feeler 83. The sensor 80 is connected via a cable connection (not shown) to the lock electronics located—as previously described—in the underhousing 5. The lock electronics are not shown in the figures, for reasons of simplification.

The microswitch 82 is so positioned in accordance with FIG. 15 that when the slide 15 is not displaced—i.e. in the locked position of the lock—there is a free space between the end of the slide 15 facing the microswitch 82 and the switch feeler 83 of the microswitch 82. However, if the slide is brought, in accordance with FIG. 16, into its displaced position, then the slide end of the slide 15 comes against the switch feeler 83, whereby the microswitch 82 changes its condition of switching.

As shown in FIGS. 17 and 18, it is also possible to arranged the microswitch 82 staggered laterally to the longitudinal axis of the slide, in which case there is no action on the switch feeler 83 of the microswitch 82 in the position of the slide shown in FIG. 17. In FIG. 18 the displaced position of the slide 15 is present in which the switch feeler 83 is acted on so that a change in the switching condition of the microswitch 82 is present.

Figure 20:
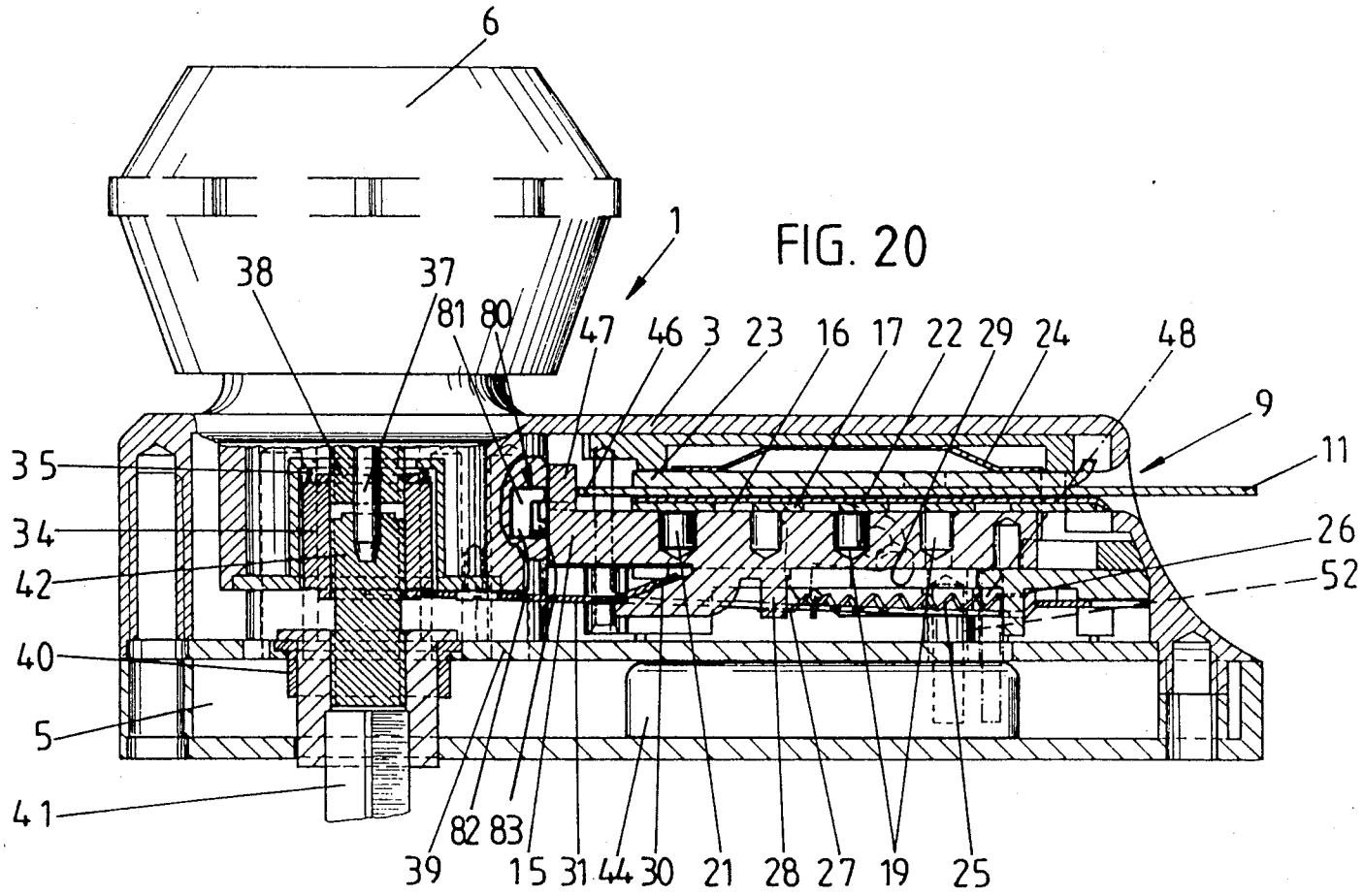
FIG. 20 is a longitudinal section similar to FIG. 19, but in the unlocked position.

Also in the embodiment shown in FIGS. 19 and 20 in which instead of the magnet coil 83 the tumbler 52 is provided with tumbler pin 53, the microswitch 82 can cooperate—as in FIGS. 15 and 16—with the slide-side surface or—as shown in FIGS. 21 and 22—the microswitch 82 can be positioned on the side of the slide 15.

The decisive factor is that when the slide is not displaced, the microswitch assumes a different condition of switching than when the slide 15 is brought into its displacement position.

In accordance with the invention, the microswitch 82 can assume the following function:

If the slide 17 is displaced by means of the "normal key" (card 11), then the microswitch 82 is actuated in the displaced position of the slide 15. This actuation is registered by the lock electronics, not shown. Furthermore, the lock electronics receives, via the reading device 44, the information that a normal key is being used since it has the supplementary code 13 which is preferably developed as bar code. If an emergency key is used, the bar code is dispensed with since corresponding magnetic pin 21 is not displaced by means of the magnetic coil 43 but from a corresponding magnetic region of the emergency key. The absence of the bar code thus indicates to the lock electronics that an emergency key has been inserted into the lock 1. The lock electronics can also be advised in each case, via a special identification character of the supplementary code, that a normal card is being used. If the supplementary code does not have this special identification character, for instance in the case of an emergency key, it is then recorded that an emergency key operation is present. In the slide displacement position shown in FIG. 16, the microswitch 82 then responds, as a result of which a monitoring circuit forming part of the lock electronics receives a signal if the lock electronics is intact. This monitoring circuit at the same time tests the operability of the lock electronics, particularly whether a supply voltage is present. If an emergency key operation is effected, although the monitoring circuit records operable lock electronics, a signal will be given off by the monitoring circuit indicating the existence of this operating condition. The signal may be an acoustic alarm signal; however, it is also possible for the signal to bring an additional bolt of the lock into the locked position so that the opening of the object locked with the lock is not possible. Furthermore, it can be provided that the occurrence of the signal is recorded in a memory of the lock electronics.

If a lock actuation by emergency key is effected and the monitoring circuit records a non-operable lock electronics, no signal is given off, so that such a manner of operation does not lead to the giving of an alarm and does not shift the additional bolt into the locked position. The housing last described represents a desired manner of operation since it is specifically upon the failure of the lock electronics that the emergency key is to enter into operation.

In accordance with another embodiment of the invention, the microswitch 82 serves, in addition to its previously described manner of operation or as an alternative to same, to take over in a memory of the lock electronics program commands which are detected by the reading device 44. For the programming of the lock electronics, the use of a special key is necessary which, in addition to its base code for the displacement of the tumbler pins 21 as a result of magnetic action, has a special coding which is developed in particular as bar code. Instead of the bar code, however, a pattern of holes may also be present on the card 11, it being detected by the optical reading device 44 by means of the sensor 48. As an alternative, it is furthermore possible to provide an induction reading head which is connected to the reading device 44 and scans a magnetic-strip code of the card 11 which represents the special code.

The arrangement is now such that the command code of the special key is recorded in the memory of the lock electronic system only when the microswitch 82 responds due to corresponding displacement of the slide. In this way, misuse is excluded since a programming or erasing of the memory of the lock electronics is possible by means of the special key only when a displacement of the slide is also effected with same. Thus it is prevented that the program of the special codings of the special key is not taken over by the memory already upon the insertion of the special key into the insertion slot 9. Rather, first of all there is required a displacement of the slide, which presupposes a "suitable" key, in order to cause corresponding removal from storage only upon actuation of the microswitch 42. In this way, assurance is had that a reprogramming can be carried out only by the person who has the proper key—with respect to the basic code and the supplementary code. Cards which while they have the same command program as the special key belonging to the lock, do not effect a displacement of all tumblers 22 cannot lead to a reprogramming of the lock electronics. In other words, prior to a programming, inquiry is first of all made as to the "mechanical" (permanent-magnet) code.

In this connection it is not necessary that the additional tumbler be displaced electromagnetically by means of the bar code; rather, it can also be provided that the additional tumbler pin be shifted by means of a suitable magnetic coding place on the card 11. There is then concerned, so to speak, an emergency key which is used for the reprogramming work.

I claim:

1. In a locking device including a lock and key and tumblers of the lock which can be brought into a release position by means of the key, the improvement comprising a magnetic coil and a reading device, wherein at least one tumbler of the lock being brought into a release position by means of said magnetic coil, said magnetic coil being energizable by said reading device which detects at least one supplementary code of said key, the key is a magnetic key, and the locking device further comprising a lock housing having a slide disposed therein displaceable by means of a properly coded magnetic key, said slide in its displaced position moves the lock into an unlocked position, an underhousing is placed on said lock housing and is adapted to receive the reading device.

2. A locking device according to claim 1, wherein the reading device is an optical reading device, and said supplementary code is a bar code which is readable by the optical reading device.

3. A locking device according to claim 1, wherein the reading device is an optical reading device, and said supplementary code is formed by a pattern of holes which pass through the key and are detectable by the optical reading device.

4. A locking device according to claim 1, wherein said reading device includes an induction reading head and the supplementary code is a magnetic code scanned by said induction reading head, the supplementary code having code places distributed between magnetic regions representing a basic code of the key for said tumblers.

5. A locking device according to claim 1, wherein said supplementary code comprises an information code and a reading clock code.

6. A locking device according to claim 1, wherein the key is a magnetic key, and the magnetic key is a card.

7. A locking device according to claim 2, wherein the key is a card which bears the bar code on at least one flat side.

8. In a locking device including a lock and key and tumblers of the lock which can be brought into a release position by means of the key, the improvement comprising a magnetic coil and a reading device, wherein at least one tumbler of the lock being brought into a release position by means of said magnetic coil, said magnetic coil being energizable by said reading device which detects at least one supplementary code of said key, a housing, a hole plate fastened to the housing and having holes, the tumblers comprise magnetic pins, and a slide has a resting surface which lies on said hole plate, said resting surface having receiving recesses in which the magnetic pins are displaceably contained, and the holes of the hole plate are aligned with the receiving recesses in a basic position of the slide, at least one other receiving recess is arranged on a side of the slide opposite the resting surface of the slide, and a magnetic pin cooperates in said at least one other receiving recess in locking position with a stop on a side of the housing.

9. A locking device according to claim 8, wherein the slide includes a magnetic pin support, at least one receiving recess, containing a magnetic pin displaceable therein, is arranged in said magnetic pin support, the latter being mounted for rotation on the slide and adapted to be fastened in given positions of rotation.

10. A locking device according to claim 8, wherein one of the receiving recesses is surrounded by the magnetic coil.

11. A locking device according to claim 8, wherein said at least one tumbler is formed as an electromagnetically displaceable tumbler pin on a side of the housing which tumbler pin is engaged in locking position into a recess in the slide.

12. A locking device according to claim 11, further comprising a specific normal key card provided with a non-magnetic region on the coding place thereof associated with the electromagnetically displaceable tumbler pin.

13. A locking device according to claim 11, further comprising a master emergency key card has a magnetic region at a coding place thereof associated with the electromagnetically displaceable tumbler pin.

14. A locking device including a lock and a key and having a housing within which there is a slide displaceable by means of the key which moves tumblers of the lock into a release position, said slide, in its displaced position, moving the lock into an unlocked position, the key having a base code developed as a magnetic code for displacing the tumblers in response to magnetic forces, and said device further including a reading device for detecting a supplementary code of the key and electromagnetically controlling at least one additional tumbler of the lock, and an emergency key, said emergency key, in addition to the magnetic base code, having a magnetic region for tumbler displacement on its coding place associated with the electromagnetically controlled additional tumbler, a sensor of a monitoring circuit which tests lock electronics as to operability, said sensor responding by bringing the slide into its displaced position, said monitoring circuit giving off, when the lock electronics is functionable and with emergency key operation, a signal, upon sensor response, indicating existing operating condition, and an additional bolt of the lock is brought into closing position upon the occurrence of said signal.

15. A locking device according to claim 14, wherein said signal is an acoustic alarm signal.

16. A locking device according to claim 14, wherein said lock electronics includes memory for recording the occurrence of the signal.

17. A locking device according to claim 14, wherein the first-mentioned key, as well as the emergency key, are each formed as a card.

18. A locking device according to claim 14, wherein the slide is provided on a resting surface with receiving recesses and said tumblers are magnetic pins displaceably contained within said recesses, and a hole plate fixed to said housing and having holes aligned within the receiving recesses in a basic position of the slide.

19. A locking device according to claim 14, wherein the sensor is an electric switch.

20. A locking device according to claim 19, wherein said switch is a microswitch having a switch sensor which cooperates with the slide.

21. In a locking device including a lock and magnetic key, a housing of the lock containing a slide which is displaceable by means of the key moving tumblers of the lock into a release position, which slide, in its displaced position moving the lock into an unlocked position, the improvement comprising a reading device which detects a supplementary code of said key and controls at least one additional tumbler of the lock which releases the slide, and the additional tumbler is formed as an electromagnetically displaceable tumbler pin on a side of the housing which tumbler pin is engaged in locking position into a recess in the slide.

22. A locking device according to claim 21, further comprising a specific normal key card provided with a non-magnetic region on the coding place thereof associated with said electromagnetically displaceable tumbler pin.

23. A locking device according to claim 21, further comprising a master emergency key card having a magnetic region at a coding place thereof associated with said electromagnetically displaceable tumbler pin.

24. In a locking device including a lock and magnetic key, a housing of the lock containing a slide which is displaceable by means of the key moving tumblers of the lock into a release position, which slide, in its displaced position moving the lock into an unlocked position, the improvement comprising a reading device which detects a supplementary code of said key and controls at least one additional tumbler of the lock which releases the slide, and an underhousing is placed on the housing and is adapted to receive the reading device.

25. A locking device according to claim 24, wherein the reading device is an optical reading device, and said supplementary code is a bar code which is readable by the optical reading device.

26. A locking device according to claim 24, wherein the reading device is an optical reading device, and said supplementary code is formed by a pattern of holes which pass through the key and are detectable by the optical reading device.

27. A locking device according to claim 24, wherein said reading device includes an induction reading head and the supplementary code is a magnetic code scanned by said induction reading head, the supplementary code having code places distributed between magnetic regions representing a basic code of the key for said tumblers.

28. A locking device according to claim 24, wherein said supplementary code comprises an information code and a reading clock code.

29. A locking device according to claim 24, wherein the key is a magnetic key, and the magnetic key is a card.

30. A locking device according to claim 25, wherein the key is a card which bears the bar code on at least one flat side.

31. In a locking device including a lock and magnetic key, a housing of the lock containing a slide which is displaceable by means of the key moving tumblers of the lock into a release position, which slide, in its displaced position moving the lock into an unlocked position, the improvement comprising a reading device which detects a supplementary code of said key and controls at least one additional tumbler of the lock which releases the slide, a hole plate fastened to the housing and having holes, and wherein the tumblers are magnetic pins, the slide has a resting surface which lies on said hole plate, said resting surface having receiving recesses in which the magnetic pins are displaceably contained, and the holes of the hole plate are aligned within the receiving recesses in a basic position of the slide, at least one other receiving recess is arranged on a side of the slide opposite the resting surface of the slide, and a magnetic pin cooperates in said at least one other receiving recess in locking position with a stop on a side of the housing.

32. A locking device according to claim 31, wherein the slide includes a magnetic pin support, at least one receiving recess, containing displaceably therein a magnetic pin, is arranged in said magnetic pin support, the latter being mounted for rotation on the slide and adapted to be fastened in given positions of rotation.

33. A locking device according to claim 31, wherein one of said receiving recesses is surrounded by a magnetic coil.

* * * * *